US010229631B2

(12) United States Patent
Lee et al.

(10) Patent No.: US 10,229,631 B2
(45) Date of Patent: Mar. 12, 2019

(54) DISPLAY DEVICE USING SEMICONDUCTOR LIGHT-EMITTING DIODE, SCAN LINES AND DATA LINES

(71) Applicant: LG ELECTRONICS INC., Seoul (KR)

(72) Inventors: Jaewoon Lee, Seoul (KR); Chisun Kim, Seoul (KR); Janghwan Cho, Seoul (KR); Bongchu Shim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 81 days.

(21) Appl. No.: 15/070,791

(22) Filed: Mar. 15, 2016

(65) Prior Publication Data

US 2017/0032735 A1 Feb. 2, 2017

(30) Foreign Application Priority Data

Jul. 31, 2015 (KR) ..... 10-2015-0109037

(51) Int. Cl.
*G09G 3/32* (2016.01)
*G09G 3/3225* (2016.01)

(52) U.S. Cl.
CPC ..... *G09G 3/32* (2013.01); *G09G 3/3225* (2013.01); *G09G 2300/0426* (2013.01); *G09G 2310/0221* (2013.01); *G09G 2310/0264* (2013.01); *G09G 2310/0278* (2013.01); *G09G 2310/0281* (2013.01); *G09G 2310/08* (2013.01); *G09G 2380/02* (2013.01)

(58) Field of Classification Search
CPC ..... G09G 3/3225; G09G 3/32; G09G 2300/0426; G09G 2310/0221; G09G 2310/0278; G09G 2310/0281; G09G 2380/02; G09G 2310/0264; G09G 2310/08
See application file for complete search history.

(56) References Cited

U.S. PATENT DOCUMENTS 7,453,542 B2 * 11/2008 Muramatsu ..... G02F 1/1345 349/149
9,633,594 B2 * 4/2017 Yang ..... G09G 3/2092
2006/0077191 A1 4/2006 Ming-Daw et al.
2007/0296650 A1 12/2007 Chang
2008/0048934 A1 2/2008 Yamamoto et al.
(Continued)

FOREIGN PATENT DOCUMENTS

CN 101093640 A 12/2007
WO WO 2006/121914 A2 11/2006

*Primary Examiner* — Kwang-Su Yang
(74) *Attorney, Agent, or Firm* — Birch, Stewart, Kolasch & Birch, LLP

(57) ABSTRACT

A display device including semiconductor light-emitting diodes; a plurality of scan lines configured to transmit a scan driving signal to the semiconductor light-emitting diodes and located parallel to each other; a plurality of data lines intersecting the scan lines and configured to transmit a data driving signal to the semiconductor light-emitting diodes; and a first driver and a second driver connected to the scan lines and the data lines and configured to provide the scan driving signal and the data driving signal. Further, the data lines are split into a first data group of data lines connected to the first driver and a second data group of data lines connected to the second driver.

17 Claims, 19 Drawing Sheets

(56) References Cited

U.S. PATENT DOCUMENTS

| | | | | |
|---|---|---|---|---|
| 2008/0291137 | A1 | 11/2008 | Tsuji | |
| 2010/0073332 | A1 | 3/2010 | Gettemy et al. | |
| 2013/0207134 | A1 | 8/2013 | Shin et al. | |
| 2013/0277650 | A1 | 10/2013 | Yoneya et al. | |
| 2014/0110747 | A1* | 4/2014 | Iwanaga | H01L 33/38 257/99 |
| 2014/0253419 | A1 | 9/2014 | Tanada | |
| 2015/0115296 | A1 | 4/2015 | Rhee et al. | |
| 2016/0259368 | A1* | 9/2016 | Bibl | G06F 3/0412 |
| 2017/0053597 | A1* | 2/2017 | Kim | G09G 3/3266 |

* cited by examiner

DISPLAY DEVICE USING SEMICONDUCTOR LIGHT-EMITTING DIODE, SCAN LINES AND DATA LINES

CROSS-REFERENCE TO RELATED APPLICATIONS

Pursuant to 35 U.S.C. § 119(a), this application claims the benefit of earlier filing date and right of priority to Korean Patent Application No. 10-2015-0109037, filed on Jul. 31, 2015 the contents of which is incorporated by reference herein in its entirety.

BACKGROUND OF THE INVENTION

1. Field of the Invention

The present invention relates to a display device, and more particularly, to a display device using a semiconductor light-emitting diode.

2. Description of the Conventional Art

In recent years, display devices having excellent characteristics such as low profile, flexibility and the like have been developed in the display technical field. On the contrary, currently commercialized main displays are represented by liquid crystal displays (LCDs) and active matrix organic light emitting diodes (AMOLEDs). However, there exist problems such as a slow response time, difficult implementation of flexibility for LCDs, and there exist drawbacks such as short life span, poor yield as well as low flexibility for AMOLEDs. Another disadvantage is that circular displays are hard to implement.

Further, light emitting diodes (LEDs) convert an electrical current to light, and have been used as a light source for displaying an image in an electronic device including information communication devices since red LEDs using GaAsP compound semiconductors were made commercially available in 1962, together with a GaP:N-based green LEDs. Accordingly, the semiconductor light emitting devices may be used to implement a flexible display.

A circular display using a semiconductor light-emitting diode is narrow especially on the bezel, and this makes wiring connections between a display panel part and a driver IC difficult.

SUMMARY OF THE INVENTION

The present invention has been made in an effort to solve the aforementioned problems, and an aspect of the present invention is to implement a circular display using a semiconductor light-emitting diode.

Another aspect of the present invention is to implement a display device with a narrow bezel and a method of manufacturing the same.

One exemplary embodiment of the present invention provides a display device including: semiconductor light-emitting diodes; a plurality of scan lines that are configured to transmit a scan driving signal to the semiconductor light-emitting diodes and located parallel to each other; a plurality of data lines that intersect the scan lines so as to transmit a data driving signal to the semiconductor light-emitting diodes; and a first driver and a second driver that are connected to the scan lines and the data lines and provide the scan driving signal and the data driving signal, wherein at least one of the scan lines may be connected to either the first driver or the second driver, and some of the data lines intersecting the at least one scan line may be connected to the first driver and the others may be connected to the second driver.

Additionally, since conductive electrodes of the semiconductor light-emitting diodes are connected to connecting portions including a plurality of layers, the data lines and the scan lines can be both connected to the drivers located on the wiring substrate, despite the level difference between them.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Figure 1:
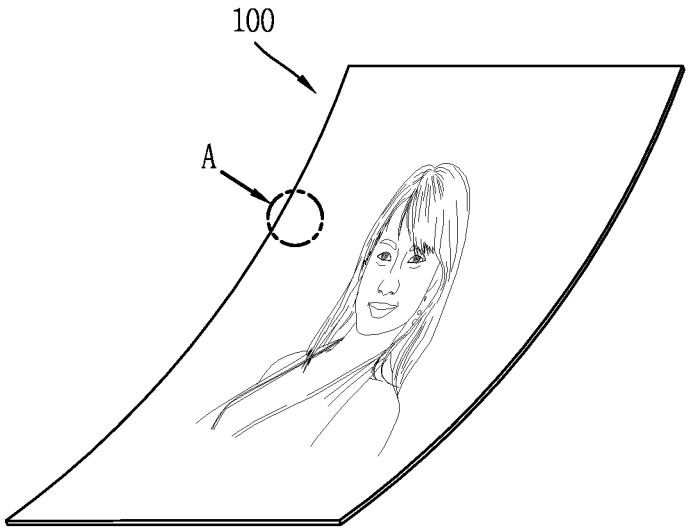
FIG. 1 is a conceptual view illustrating a display device using a semiconductor light emitting device according to an embodiment of the present disclosure.

Hereinafter, the embodiments disclosed herein will be described in detail with reference to the accompanying drawings, and the same or similar elements are designated with the same numeral references regardless of the numerals in the drawings and their redundant description will be omitted. A suffix "module" or "unit" used for constituent elements disclosed in the following description is merely intended for easy description of the specification, and the suffix itself does not give any special meaning or function. In describing the embodiments disclosed herein, moreover, the detailed description will be omitted when a specific description for publicly known technologies to which the invention pertains is judged to obscure the gist of the present invention.

Also, the accompanying drawings are merely illustrated to easily explain the concept of the invention, and therefore, they should not be construed to limit the technological concept disclosed herein by the accompanying drawings. Furthermore, when an element such as a layer, region or substrate is referred to as being "on" another element, it can be directly on the other element or an intermediate element may also be interposed therebetween.

A display device disclosed herein includes a portable phone, a smart phone, a laptop computer, a digital broadcast terminal, a personal digital assistant (PDA), a portable multimedia player (PMP), a navigation, a slate PC, a tablet PC, an ultrabook, a digital TV, a desktop computer, and the like. However, it would be easily understood by those skilled in the art that a configuration disclosed herein may be applicable to any displayable device even though it is a new product type which will be developed later.

FIG. 1 is a conceptual view illustrating a display device 100 using a semiconductor light emitting device according to an embodiment of the present disclosure. According to the drawing, information processed in a controller of the display device 100 can be displayed using a flexible display. The flexible display includes a flexible, bendable, twistable, foldable and rollable display. For example, the flexible display may be a display fabricated on a thin and flexible substrate that can be warped, bent, folded or rolled like a paper sheet while maintaining the display characteristics of a flat display in the related art.

A display area of the flexible display becomes a plane in a configuration that the flexible display is not warped (for example, a configuration having an infinite radius of curvature, hereinafter, referred to as a "first configuration"). The display area thereof becomes a curved surface in a configuration that the flexible display is warped by an external force in the first configuration (for example, a configuration having a finite radius of curvature, hereinafter, referred to as a "second configuration"). As illustrated in the drawing, information displayed in the second configuration may be visual information displayed on a curved surface. The visual information may be implemented by individually controlling the light emission of sub-pixels disposed in a matrix form. The sub-pixel denotes a minimum unit for implementing one color.

The sub-pixel of the flexible display may be implemented by a semiconductor light emitting device. According to the present disclosure, a light emitting diode (LED) is illustrated as a type of semiconductor light emitting device. The light emitting diode may be formed with a small size to perform the role of a sub-pixel even in the second configuration through this.

Hereinafter, a flexible display implemented using the light emitting diode will be described in more detail with reference to the accompanying drawings. In particular, FIG. 2 is a partial enlarged view of portion "A" in FIG. 1, FIGS. 3A and 3B are cross-sectional views taken along lines B-B and C-C in FIG. 2, FIG. 4 is a conceptual view illustrating a flip-chip type semiconductor light emitting device in FIG. 3A, and FIGS. 5A through 5C are conceptual views illustrating various forms for implementing colors in connection with a flip-chip type semiconductor light emitting device.

Figure 2:
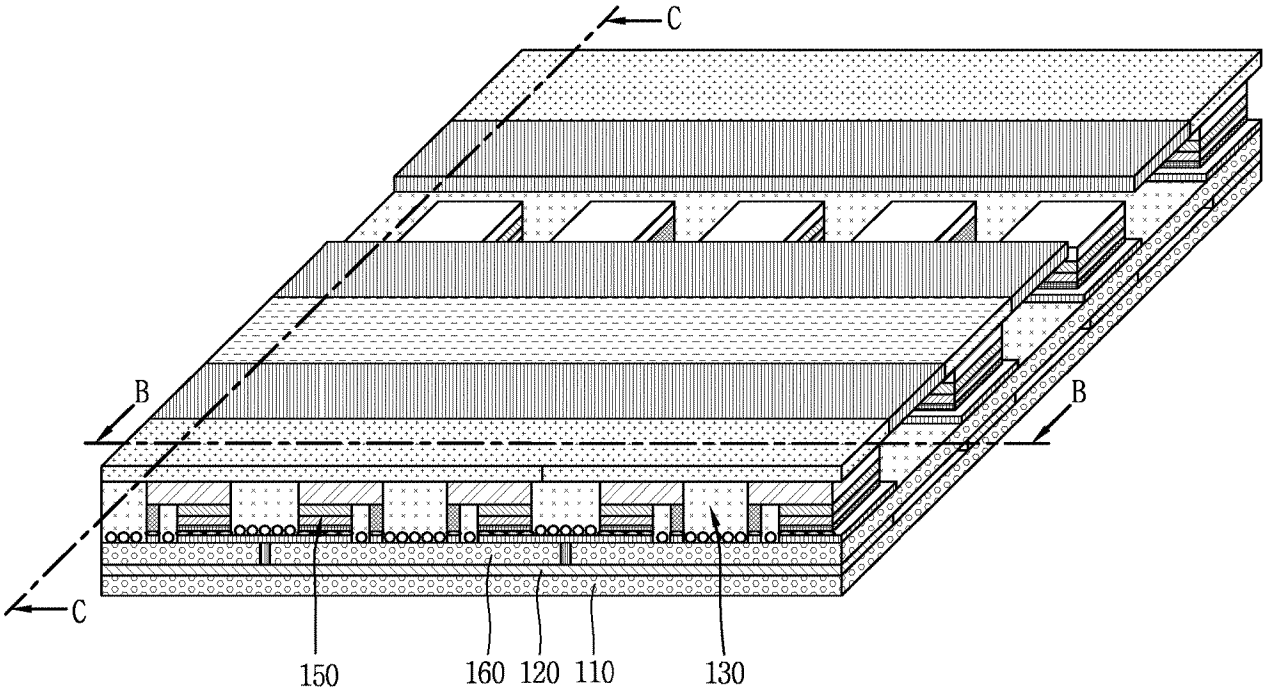
FIG. 2 is a partial enlarged view of portion "A" in FIG. 1.
Figure 3A:
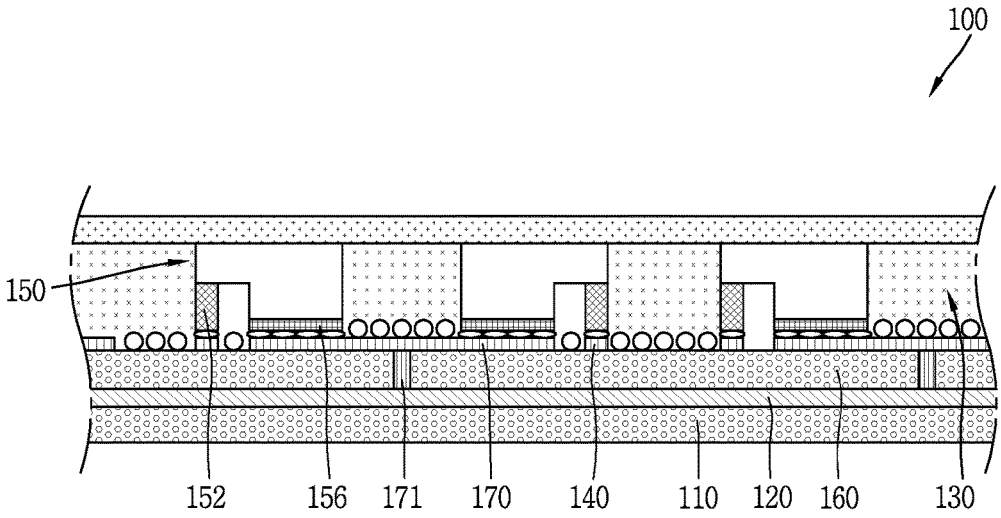
FIGS. 3A and 3B are cross-sectional views taken along lines B-B and C-C in FIG. 2.
Figure 3B:
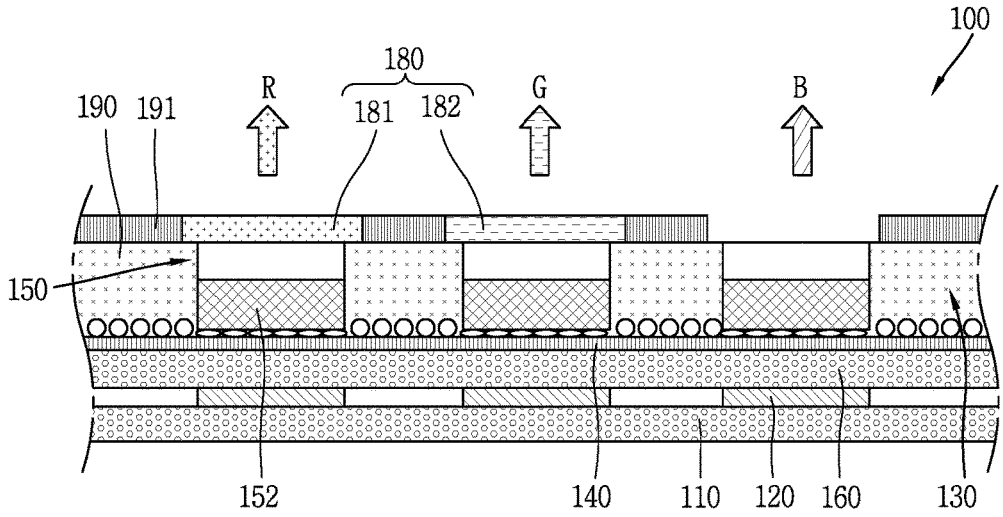
Figure 4:
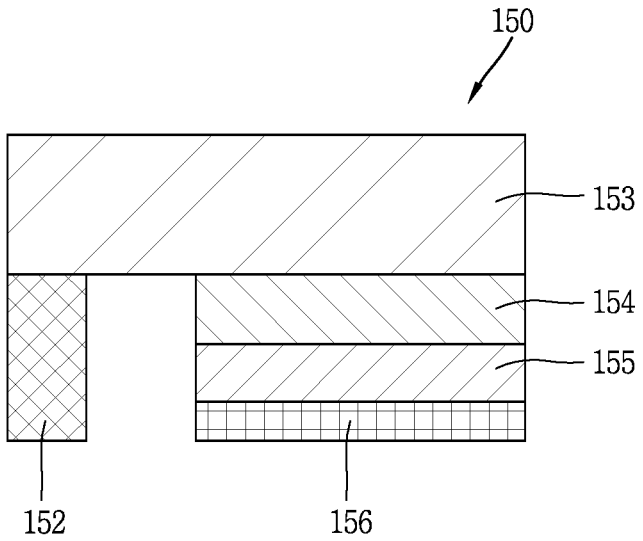
FIG. 4 is a conceptual view illustrating a flip-chip type semiconductor light emitting device in FIG. 3A.

FIGS. 2, 3A and 3B illustrate a display device 100 using a passive matrix (PM) type semiconductor light emitting device. However, the following illustration is also applicable to an active matrix (AM) type semiconductor light emitting device.

As shown, the display device 100 includes a substrate 110, a first electrode 120, a conductive adhesive layer 130, a second electrode 140, and a plurality of semiconductor light emitting devices 150. The substrate 110 may be a flexible substrate. The substrate 110 may contain glass or polyimide (PI) to implement the flexible display device. In addition, if it is a flexible material, any one such as polyethylene naphthalate (PEN), polyethylene terephthalate (PET) or the like may be used. Furthermore, the substrate 110 may be either one of transparent and non-transparent materials.

The substrate 110 may be a wiring substrate disposed with the first electrode 120, and thus the first electrode 120 may be placed on the substrate 110. According to the drawing, an insulating layer 160 may be disposed on the substrate 110 placed with the first electrode 120, and an auxiliary electrode 170 may be placed on the insulating layer 160. In this instance, a configuration in which the insulating layer 160 is deposited on the substrate 110 may be single wiring substrate. More specifically, the insulating layer 160 may be incorporated into the substrate 110 with an insulating and flexible material such as polyimide (PI), PET, PEN or the like to form single wiring substrate.

The auxiliary electrode 170 as an electrode for electrically connecting the first electrode 120 to the semiconductor light emitting device 150 is placed on the insulating layer 160, and disposed to correspond to the location of the first electrode 120. For example, the auxiliary electrode 170 has a dot shape, and may be electrically connected to the first electrode 120 by an electrode hole 171 passing through the insulating layer 160. The electrode hole 171 may be formed by filling a conductive material in a via hole.

Referring to the drawings, the conductive adhesive layer 130 is formed on one surface of the insulating layer 160, but the present disclosure is not limited to this. For example, it is possible to also have a structure in which the conductive adhesive layer 130 is disposed on the substrate 110 with no insulating layer 160. The conductive adhesive layer 130 performs the role of an insulating layer in the structure in which the conductive adhesive layer 130 is disposed on the substrate 110.

The conductive adhesive layer 130 may be a layer having adhesiveness and conductivity, and thus a conductive material and an adhesive material may be mixed on the conductive adhesive layer 130. Furthermore, the conductive adhesive layer 130 can have flexibility, thereby allowing a flexible function in the display device.

For example, the conductive adhesive layer 130 may be an anisotropic conductive film (ACF), an anisotropic conductive paste, a solution containing conductive particles, and the like. The conductive adhesive layer 130 may allow electrical interconnection in the z-direction passing through the thickness thereof, but may be configured as a layer having electrical insulation in the horizontal x-y direction thereof. Accordingly, the conductive adhesive layer 130 may be referred to as a z-axis conductive layer (however, hereinafter referred to as a "conductive adhesive layer").

The anisotropic conductive film is a film with a form in which an anisotropic conductive medium is mixed with an insulating base member, and thus when heat and pressure are applied thereto, only a specific portion thereof may have conductivity by the anisotropic conductive medium. Hereinafter, heat and pressure are applied to the anisotropic conductive film, but other methods may be also available for the anisotropic conductive film to partially have conductivity. The methods may include applying only either one of heat and pressure thereto, UV curing, and the like.

Furthermore, the anisotropic conductive medium may be conductive balls or particles. According to the drawing, in the present embodiment, the anisotropic conductive film is a film including an anisotropic conductive medium mixed with an insulating base member, and thus when heat and pressure are applied thereto, only a specific portion thereof can have conductivity by the conductive balls. The anisotropic conductive film may be in a state in which a core with a conductive material contains a plurality of particles coated by an insulating layer with a polymer material, and in this instance, it may have conductivity by the core while breaking an insulating layer on a portion to which heat and pressure are applied. Here, a core may be transformed to implement a layer having both surfaces to which objects contact in the thickness direction of the film.

For a more specific example, heat and pressure are applied to an anisotropic conductive film as a whole, and electrical connection in the z-axis direction is partially formed by a height difference from a mating object adhered by the use of the anisotropic conductive film. In another example, an anisotropic conductive film may be in a state containing a plurality of particles in which a conductive material is coated on insulating cores. In this instance, a portion to which heat and pressure are applied may be converted (pressed and adhered) to a conductive material to have conductivity in the thickness direction of the film. In still another example, it may be formed to have conductivity in the thickness direction of the film in which a conductive material passes through an insulating base member in the z-direction. In this instance, the conductive material may have a pointed end portion.

According to the drawing, the anisotropic conductive film may be a fixed array anisotropic conductive film (ACF) configured with a form in which conductive balls are inserted into one surface of the insulating base member. More specifically, the insulating base member is formed of an adhesive material, and the conductive balls are intensively disposed at a bottom portion of the insulating base member, and when heat and pressure are applied thereto, the base member is modified along with the conductive balls, thereby having conductivity in the vertical direction thereof.

However, the present disclosure is not limited to this, and the anisotropic conductive film can include conductive balls randomly mixed with an insulating base member or a plurality of layers in which conductive balls are disposed at any one layer (double-ACF), and the like.

The anisotropic conductive paste as a form coupled to a paste and conductive balls may be a paste in which conductive balls are mixed with an insulating and adhesive base material. Furthermore, a solution containing conductive particles may be a solution in a form containing conductive particles or nano particles.

Referring to the drawing again, the second electrode 140 is located at the insulating layer 160 to be separated from the auxiliary electrode 170. In other words, the conductive adhesive layer 130 is disposed on the insulating layer 160 located with the auxiliary electrode 170 and second electrode 140.

When the conductive adhesive layer 130 is formed in a state that the auxiliary electrode 170 and second electrode 140 are located, and then the semiconductor light emitting device 150 is connect thereto in a flip chip form with the application of heat and pressure, the semiconductor light emitting device 150 is electrically connected to the first electrode 120 and second electrode 140.

Referring to FIG. 4, the semiconductor light emitting device 150 may be a flip chip type semiconductor light emitting device. For example, the semiconductor light emitting device may include a p-type electrode 156, a p-type semiconductor layer 155 formed with the p-type electrode 156, an active layer 154 formed on the p-type semiconductor layer 155, an n-type semiconductor layer 153 formed on the active layer 154, and an n-type electrode 152 disposed to be separated from the p-type electrode 156 in the horizontal direction on the n-type semiconductor layer 153. In this instance, the p-type electrode 156 may be electrically connected to the welding portion 179 by the conductive adhesive layer 130, and the n-type electrode 152 may be electrically connected to the second electrode 140.

Referring to FIGS. 2, 3A and 3B again, the auxiliary electrode 170 may be formed in an elongated manner in one direction to be electrically connected to a plurality of semiconductor light emitting devices 150. For example, the left and right p-type electrodes of the semiconductor light emitting devices around the auxiliary electrode may be electrically connected to one auxiliary electrode.

More specifically, the semiconductor light emitting device 150 is pressed into the conductive adhesive layer 130, and through this, only a portion between the p-type electrode 156 and auxiliary electrode 170 of the semiconductor light emitting device 150 and a portion between the n-type electrode 152 and second electrode 140 of the semiconductor light emitting device 150 have conductivity, and the remaining portion does not have conductivity since there is no push-down of the semiconductor light emitting device.

Furthermore, a plurality of semiconductor light emitting devices 150 constitute a light-emitting array, and a phosphor layer 180 is formed on the light-emitting array. The light emitting device may include a plurality of semiconductor light emitting devices with different self luminance values. Each of the semiconductor light emitting devices 150 constitutes a sub-pixel, and is electrically connected to the first electrode 120. For example, there may exist a plurality of first electrodes 120, and the semiconductor light emitting devices are arranged in several rows, for instance, and each row of the semiconductor light emitting devices may be electrically connected to any one of the plurality of first electrodes.

In addition, the semiconductor light emitting devices may be connected in a flip chip form, and thus semiconductor light emitting devices grown on a transparent dielectric substrate. Furthermore, the semiconductor light emitting devices may be nitride semiconductor light emitting devices, for instance. The semiconductor light emitting device 150 has an excellent luminance characteristic, and thus it is possible to configure individual sub-pixels even with a small size thereof.

According to FIG. 3B, a partition wall 190 may be formed between the semiconductor light emitting devices 150. In this instance, the partition wall 190 divides individual sub-pixels from one another, and can be formed as an integral body with the conductive adhesive layer 130. For example, a base member of the anisotropic conductive film may form the partition wall when the semiconductor light emitting device 150 is inserted into the anisotropic conductive film.

Furthermore, when the base member of the anisotropic conductive film is black, the partition wall 190 may have reflective characteristics while at the same time increasing contrast with no additional black insulator. In another example, a reflective partition wall may be separately provided with the partition wall 190. In this instance, the partition wall 190 may include a black or white insulator according to the purpose of the display device. This enhances reflectivity when the partition wall of the while insulator is used, and increase contrast while at the same time having reflective characteristics.

The phosphor layer 180 may be located at an outer surface of the semiconductor light emitting device 150. For example, the semiconductor light emitting device 150 is a blue semiconductor light emitting device that emits blue (B) light, and the phosphor layer 180 performs the role of converting the blue (B) light into the color of a sub-pixel. The phosphor layer 180 may be a red phosphor layer 181 or green phosphor layer 182 constituting individual pixels.

In other words, a red phosphor 181 capable of converting blue light into red (R) light may be deposited on the blue semiconductor light emitting device 151 at a location implementing a red sub-pixel, and a green phosphor 182 capable of converting blue light into green (G) light may be deposited on the blue semiconductor light emitting device 151 at a location implementing a green sub-pixel. In addition, only the blue semiconductor light emitting device 151 may be solely used at a location implementing a blue sub-pixel.

In this instance, the red (R), green (G) and blue (B) sub-pixels may implement one pixel. More specifically, one color phosphor may be deposited along each line of the first electrode 120. Accordingly, one line on the first electrode 120 may be an electrode controlling one color. In other words, red (R), green (B) and blue (B) may be sequentially disposed, thereby implementing sub-pixels.

However, the present disclosure is not limited to this, and the semiconductor light emitting device 150 may be combined with a quantum dot (QD) instead of a phosphor to implement sub-pixels such as red (R), green (G) and blue (B). Furthermore, a black matrix 191 may be disposed between each phosphor layer to enhance contrast. In other words, the black matrix 191 can enhance the contrast of luminance. However, the present disclosure is not limited to this, and another structure for implementing blue, red and green may be also applicable thereto.

Figure 5A:
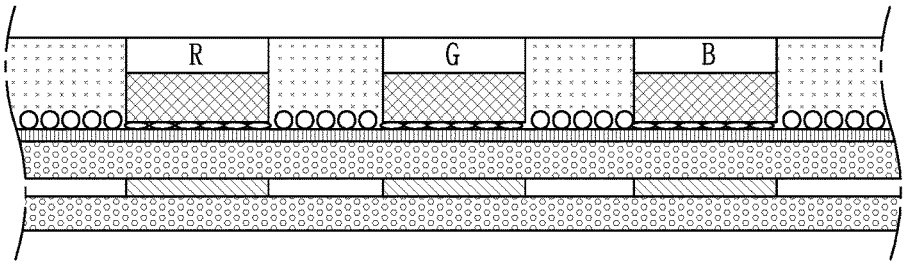
FIGS. 5A through 5C are conceptual views illustrating various forms for implementing colors in connection with a flip-chip type semiconductor light emitting device.

Referring to FIG. 5A, each of the semiconductor light emitting devices 150 may be implemented with a high-power light emitting device that emits various lights including blue in which gallium nitride (GaN) is mostly used, and indium (In) and or aluminum (Al) are added thereto. In this instance, the semiconductor light emitting device 150 may be red, green and blue semiconductor light emitting devices, respectively, to implement each sub-pixel. For instance, red, green and blue semiconductor light emitting devices (R, G, B) are alternately disposed, and red, green and blue sub-pixels implement one pixel by the red, green and blue semiconductor light emitting devices, thereby implementing a full color display.

Figure 5B:
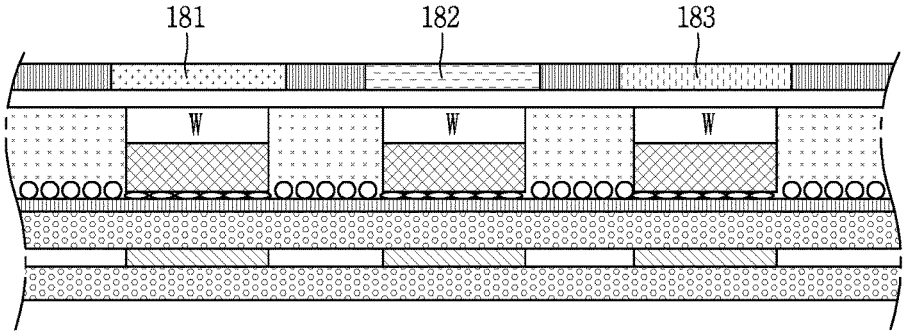

Referring to FIG. 5B, the semiconductor light emitting device may have a white light emitting device (W) provided with a yellow phosphor layer for each element. In this instance, a red phosphor layer 181, a green phosphor layer 182 and blue phosphor layer 183 may be provided on the white light emitting device (W) to implement a sub-pixel. Furthermore, a color filter repeated with red, green and blue on the white light emitting device (W) may be used to implement a sub-pixel.

Figure 5C:
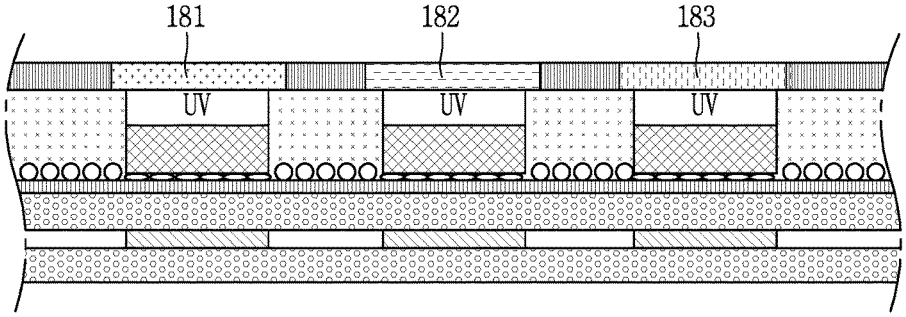

Referring to FIG. 5C, it is possible to also have a structure in which a red phosphor layer 181, a green phosphor layer 182 and blue phosphor layer 183 may be provided on a ultra violet light emitting device (UV). Thus, the semiconductor light emitting device can be used over the entire region up to ultra violet (UV) as well as visible light, and may be extended to a form of semiconductor light emitting device in which ultra violet (UV) can be used as an excitation source.

Taking the present example into consideration again, the semiconductor light emitting device 150 is placed on the conductive adhesive layer 130 to configure a sub-pixel in the display device. The semiconductor light emitting device 150 has excellent luminance characteristics, and thus it is possible to configure individual sub-pixels even with a small size thereof. The size of the individual semiconductor light emitting device 150 may be less than 80 μm in the length of one side thereof, and formed with a rectangular or square shaped element. In case of a rectangular shaped element, the size thereof may be less than 20×80 μm.

Furthermore, even when a square shaped semiconductor light emitting device 150 with a length of side of 10 μm is used for a sub-pixel, it will exhibit a sufficient brightness for implementing a display device. Accordingly, for example, in case of a rectangular pixel in which one side of a sub-pixel is 600 μm in size, and the remaining one side thereof is 300 μm, a relative distance between the semiconductor light emitting devices becomes sufficiently large. Accordingly, in this instance, it is possible to implement a flexible display device having a HD image quality.

Figure 6:
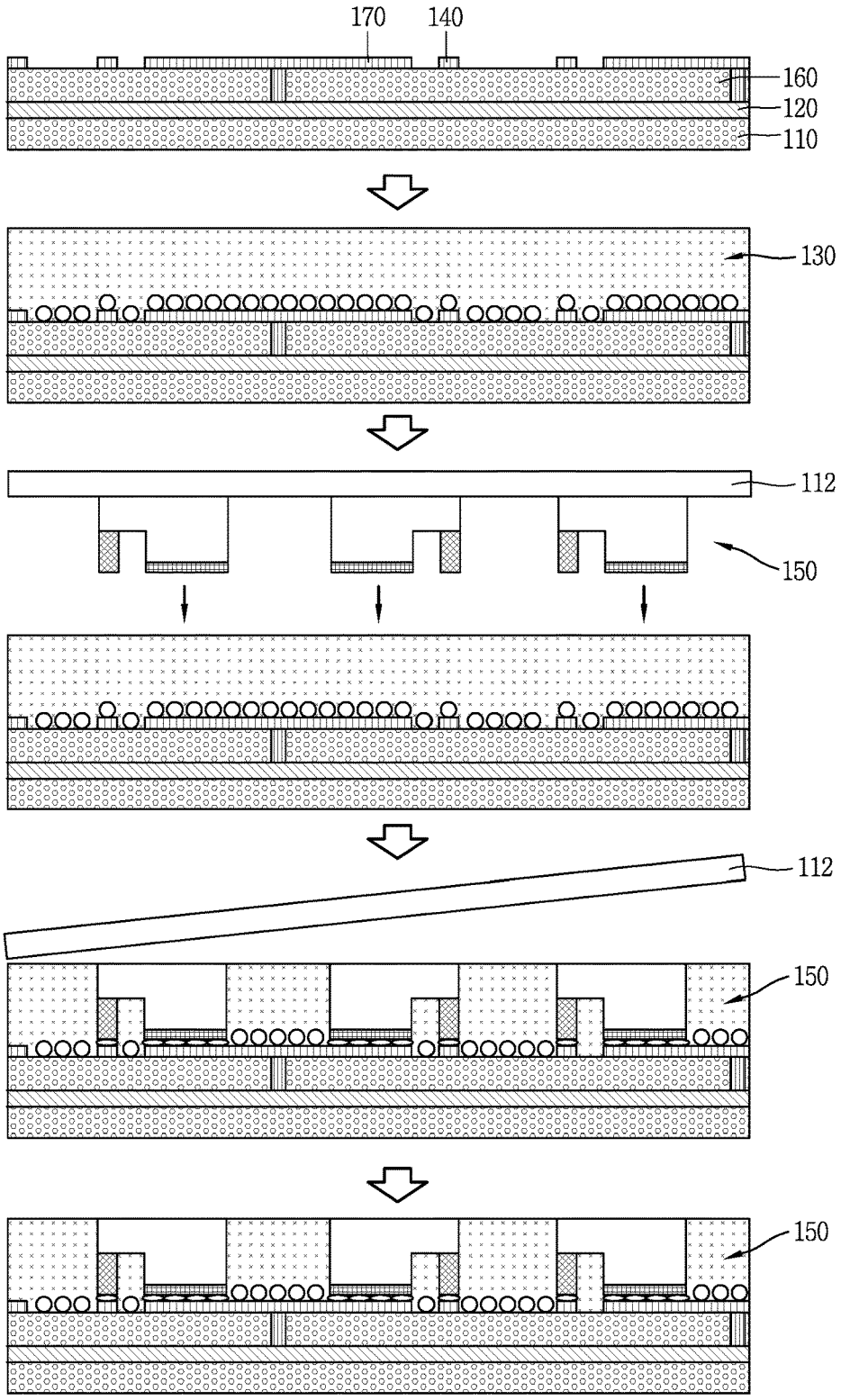
FIG. 6 is cross-sectional views illustrating a method of fabricating a display device using a semiconductor light emitting device according to the present disclosure.

A display device using the foregoing semiconductor light emitting device will be fabricated by a new type of fabrication method. Hereinafter, the fabrication method will be described with reference to FIG. 6. In particular, FIG. 6 is cross-sectional views illustrating a method of fabricating a display device using a semiconductor light emitting device according to the present disclosure.

Referring to the drawing, first, the conductive adhesive layer 130 is formed on the insulating layer 160 located with the auxiliary electrode 170 and second electrode 140. The insulating layer 160 is deposited on the first substrate 110 to form one substrate (or wiring substrate), and the first electrode 120, auxiliary electrode 170 and second electrode 140 are disposed at the wiring substrate. In this instance, the first electrode 120 and second electrode 140 may be disposed in a perpendicular direction to each other. Furthermore, the first substrate 110 and insulating layer 160 may contain glass or polyimide (PI), respectively, to implement a flexible display device.

The conductive adhesive layer 130 may be implemented by an anisotropic conductive film, for example, and thus, an anisotropic conductive film may be coated on a substrate located with the insulating layer 160. Next, a second substrate 112 located with a plurality of semiconductor light emitting devices 150 corresponding to the location of the auxiliary electrodes 170 and second electrodes 140 and constituting individual pixels is disposed such that the semiconductor light emitting device 150 faces the auxiliary electrode 170 and second electrode 140.

In this instance, the second substrate 112 as a growth substrate for growing the semiconductor light emitting device 150 may be a sapphire substrate or silicon substrate. The semiconductor light emitting device may have a gap and size capable of implementing a display device when formed in the unit of wafer, and thus effectively used for a display device.

Next, the wiring substrate is thermally compressed to the second substrate 112. For example, the wiring substrate and second substrate 112 may be thermally compressed to each other by applying an ACF press head. The wiring substrate and second substrate 112 are bonded to each other using the thermal compression. Only a portion between the semiconductor light emitting device 150 and the auxiliary electrode 170 and second electrode 140 may have conductivity due to the characteristics of an anisotropic conductive film having conductivity by thermal compression, thereby allowing the electrodes and semiconductor light emitting device 150 to be electrically connected to each other. At this time, the semiconductor light emitting device 150 may be inserted into the anisotropic conductive film, thereby forming a partition wall between the semiconductor light emitting devices 150.

Next, the second substrate 112 is removed. For example, the second substrate 112 may be removed using a laser lift-off (LLO) or chemical lift-off (CLO) method. Finally, the second substrate 112 is removed to expose the semiconductor light emitting devices 150 to the outside. Silicon oxide (SiOx) or the like may be coated on the wiring substrate coupled to the semiconductor light emitting device 150 to form a transparent insulating layer.

Furthermore, an additional process may include forming a phosphor layer on one surface of the semiconductor light emitting device 150. For example, the semiconductor light emitting device 150 may be a blue semiconductor light emitting device for emitting blue (B) light, and red or green phosphor for converting the blue (B) light into the color of the sub-pixel may form a layer on one surface of the blue semiconductor light emitting device.

The fabrication method or structure of a display device using the foregoing semiconductor light emitting device may be modified in various forms. For example, the foregoing display device may be applicable to a vertical semiconductor light emitting device. Hereinafter, the vertical structure will be described with reference to FIGS. 5 and 6. Also, according to the following modified example or embodiment, the same or similar reference numerals are designated to the same or similar configurations to the foregoing example, and the description thereof will be substituted by the earlier description.

Figure 7:
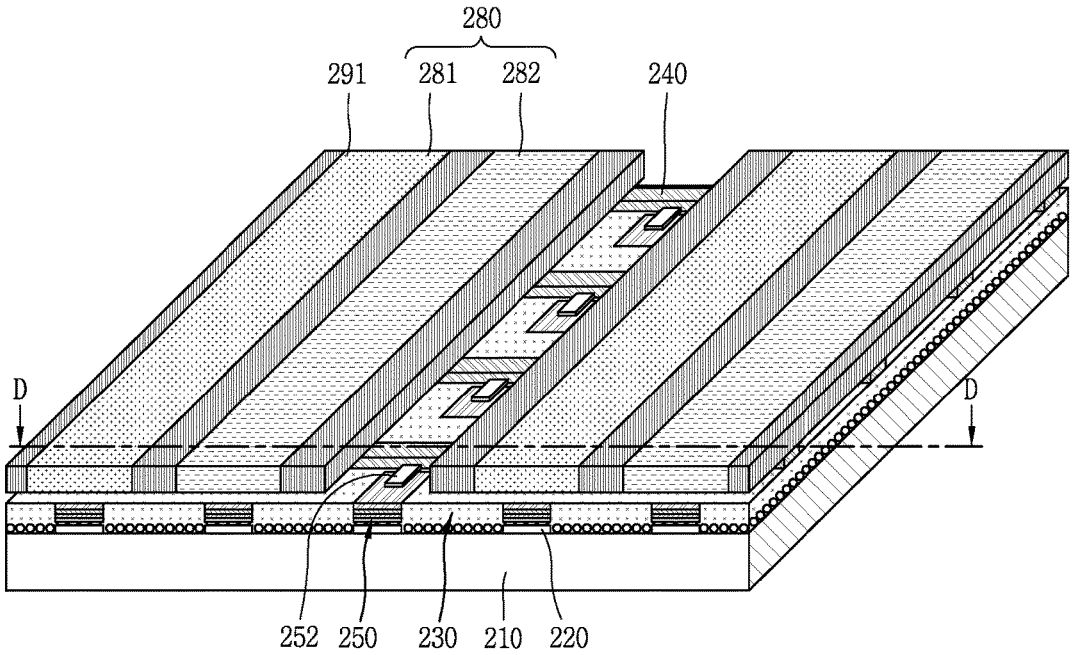
FIG. 7 is a perspective view illustrating a display device using a semiconductor light emitting device according to another embodiment of the present disclosure.
Figure 8:
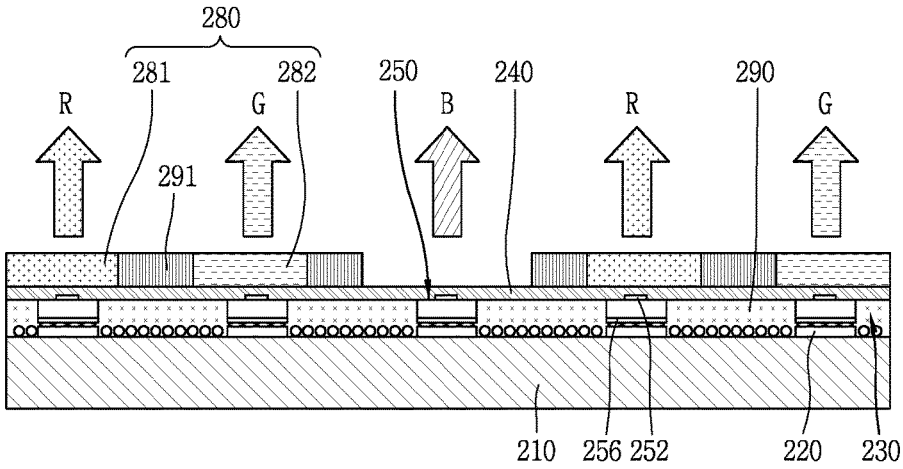
FIG. 8 is a cross-sectional view taken along line D-D in FIG. 7.
Figure 9:
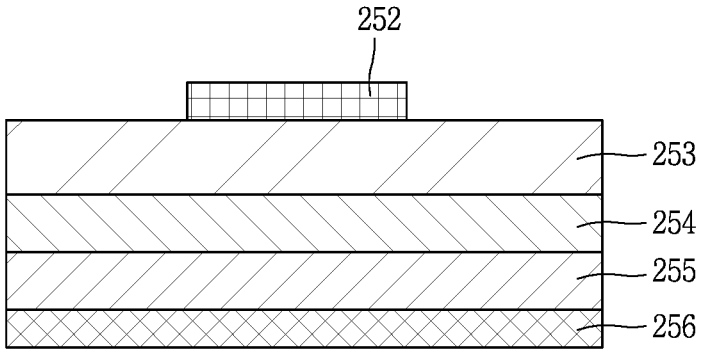
FIG. 9 is a conceptual view illustrating a vertical type semiconductor light emitting device in FIG. 8.

FIG. 7 is a perspective view illustrating a display device using a semiconductor light emitting device according to another embodiment of the present disclosure, FIG. 8 is a cross-sectional view taken along line C-C in FIG. 7, and FIG. 9 is a conceptual view illustrating a vertical type semiconductor light emitting device in FIG. 8.

According to the drawings, the display device is using a passive matrix (PM) type of vertical semiconductor light emitting device. As shown, the display device includes a substrate 210, a first electrode 220, a conductive adhesive layer 230, a second electrode 240 and a plurality of semiconductor light emitting devices 250.

The substrate 210 as a wiring substrate disposed with the first electrode 220 may include polyimide (PI) to implement a flexible display device. In addition, any one may be used if it is an insulating and flexible material. The first electrode 220 may be located on the substrate 210, and formed with an electrode having a bar elongated in one direction. The first electrode 220 may be formed to perform the role of a data electrode.

The conductive adhesive layer 230 is formed on the substrate 210 located with the first electrode 220. Similarly to a display device to which a flip chip type light emitting device is applied, the conductive adhesive layer 230 may be an anisotropic conductive film (ACF), an anisotropic conductive paste, a solution containing conductive particles, and the like. However, the present embodiment illustrates a case where the conductive adhesive layer 230 is implemented by an anisotropic conductive film.

When an anisotropic conductive film is located in a state that the first electrode 220 is located on the substrate 210, and then heat and pressure are applied to connect the semiconductor light emitting device 250 thereto, the semiconductor light emitting device 250 is electrically connected to the first electrode 220. At this time, the semiconductor light emitting device 250 may be preferably disposed on the first electrode 220.

The electrical connection is generated because an anisotropic conductive film partially has conductivity in the thickness direction when heat and pressure are applied as described above. Accordingly, the anisotropic conductive film is partitioned into a portion having conductivity and a portion having no conductivity in the thickness direction thereof. Furtheimore, the anisotropic conductive film contains an adhesive component, and thus the conductive adhesive layer 230 implements a mechanical coupling as well as an electrical coupling between the semiconductor light emitting device 250 and the first electrode 220.

Thus, the semiconductor light emitting device 250 is placed on the conductive adhesive layer 230, thereby configuring a separate sub-pixel in the display device. The semiconductor light emitting device 250 has excellent luminance characteristics, and thus it is possible to configure individual sub-pixels even with a small size thereof. The size of the individual semiconductor light emitting device 250 may be less than 80 μm in the length of one side thereof, and formed with a rectangular or square shaped element. In case of a rectangular shaped element, the size thereof may be less than 20×80 μm.

The semiconductor light emitting device 250 may be a vertical structure. A plurality of second electrodes 240 disposed in a direction crossed with the length direction of the first electrode 220, and electrically connected to the vertical semiconductor light emitting device 250 may be located between vertical semiconductor light emitting devices.

Referring to FIG. 9, the vertical semiconductor light emitting device includes a p-type electrode 256, a p-type semiconductor layer 255 formed with the p-type electrode 256, an active layer 254 formed on the p-type semiconductor layer 255, an n-type semiconductor layer 253 formed on the active layer 254, and an n-type electrode 252 formed on the n-type semiconductor layer 253. In this instance, the p-type electrode 256 located at the bottom thereof may be electrically connected to the first electrode 220 by the conductive adhesive layer 230, and the n-type electrode 252 located at the top thereof may be electrically connected to the second electrode 240 which will be described later. The electrodes may be disposed in the upward/downward direction in the vertical semiconductor light emitting device 250, thereby providing a great advantage capable of reducing the chip size.

Referring to FIG. 8 again, a phosphor layer 280 may be formed on one surface of the semiconductor light emitting device 250. For example, the semiconductor light emitting device 250 is a blue semiconductor light emitting device 251 that emits blue (B) light, and the phosphor layer 280 for converting the blue (B) light into the color of the sub-pixel may be provided thereon. In this instance, the phosphor layer 280 may be a red phosphor 281 and a green phosphor 282 constituting individual pixels.

In other words, a red phosphor 281 capable of converting blue light into red (R) light may be deposited on the blue semiconductor light emitting device 251 at a location implementing a red sub-pixel, and a green phosphor 282 capable of converting blue light into green (G) light may be deposited on the blue semiconductor light emitting device 251 at a location implementing a green sub-pixel. Furthermore, only the blue semiconductor light emitting device 251 may be solely used at a location implementing a blue sub-pixel. In this instance, the red (R), green (G) and blue (B) sub-pixels may implement one pixel. However, the present disclosure is not limited to this, and another structure for implementing blue, red and green may be also applicable thereto as described above in a display device to which a flip chip type light emitting device is applied.

In addition, the second electrode 240 is located between the semiconductor light emitting devices 250, and electrically connected to the semiconductor light emitting devices 250. For example, the semiconductor light emitting devices 250 may be disposed in a plurality of rows, and the second electrode 240 may be located between the rows of the semiconductor light emitting devices 250.

Since a distance between the semiconductor light emitting devices 250 constituting individual pixels is sufficiently large, the second electrode 240 may be located between the semiconductor light emitting devices 250. The second electrode 240 may be formed with an electrode having a bar elongated in one direction, and disposed in a perpendicular direction to the first electrode.

Furthermore, the second electrode 240 may be electrically connected to the semiconductor light emitting device 250 by a connecting electrode protruded from the second electrode 240. More specifically, the connecting electrode may be an n-type electrode of the semiconductor light emitting device 250. For example, the n-type electrode is formed with an ohmic electrode for ohmic contact, and the second electrode covers at least part of the ohmic electrode by printing or deposition. Through this, the second electrode 240 may be electrically connected to the n-type electrode of the semiconductor light emitting device 250.

According to the drawing, the second electrode 240 is located on the conductive adhesive layer 230. Further, a transparent insulating layer containing silicon oxide (SiOx) can be formed on the substrate 210 formed with the semiconductor light emitting device 250. When the transparent insulating layer is formed and then the second electrode 240 is placed thereon, the second electrode 240 may be located on the transparent insulating layer. Furthermore, the second electrode 240 may be formed to be separated from the conductive adhesive layer 230 or transparent insulating layer.

If a transparent electrode such as indium tin oxide (ITO) is used to locate the second electrode 240 on the semiconductor light emitting device 250, the ITO material has a problem of bad adhesiveness with an n-type semiconductor. Accordingly, the second electrode 240 can be placed between the semiconductor light emitting devices 250, thereby obtaining an advantage in which the transparent electrode is not required. Accordingly, an n-type semiconductor layer and a conductive material having a good adhesiveness may be used as a horizontal electrode without being restricted by the selection of a transparent material, thereby enhancing the light extraction efficiency.

In addition, a partition wall 290 can be formed between the semiconductor light emitting devices 250. In other words, the partition wall 290 may be disposed between the vertical semiconductor light emitting devices 250 to isolate the semiconductor light emitting device 250 constituting individual pixels. In this instance, the partition wall 290 may perform the role of dividing individual sub-pixels from one another, and be formed as an integral body with the conductive adhesive layer 230. For example, a base member of the anisotropic conductive film may form the partition wall when the semiconductor light emitting device 250 is inserted into the anisotropic conductive film.

Furthermore, when the base member of the anisotropic conductive film is black, the partition wall 290 has reflective characteristics while at the same time increasing contrast with no additional black insulator. In another example, a reflective partition wall can be separately provided with the partition wall 290. In this instance, the partition wall 290 may include a black or white insulator according to the purpose of the display device.

If the second electrode 240 is precisely located on the conductive adhesive layer 230 between the semiconductor light emitting devices 250, the partition wall 290 can be located between the semiconductor light emitting device 250 and second electrode 240. Accordingly, individual sub-pixels may be configured even with a small size using the semiconductor light emitting device 250, and a distance between the semiconductor light emitting devices 250 may be relatively sufficiently large to place the second electrode 240 between the semiconductor light emitting devices 250, thereby having the effect of implementing a flexible display device having a HD image quality.

Furthermore, a black matrix 291 can be disposed between each phosphor layer to enhance contrast. In other words, the black matrix 291 can enhance the contrast of luminance. As described above, the semiconductor light emitting device 250 is located on the conductive adhesive layer 230, thereby constituting individual pixels on the display device. Since the semiconductor light emitting device 250 has excellent luminance characteristics, thereby configuring individual sub-pixels even with a small size thereof. As a result, it is possible to implement a full color display in which the sub-pixels of red (R), green (G) and blue (B) implement one pixel by the semiconductor light emitting device.

In the case that flip chip is used for the above-explained display device using a semiconductor light-emitting diode according to an embodiment of the present invention, first and second electrodes are located in the same plane, thus making it difficult to enable fine pitch interconnection. Hereinafter, a display device using a flip-chip type light-emitting device according to another embodiment of the present invention that can solve this problem will be described.

Figure 10:
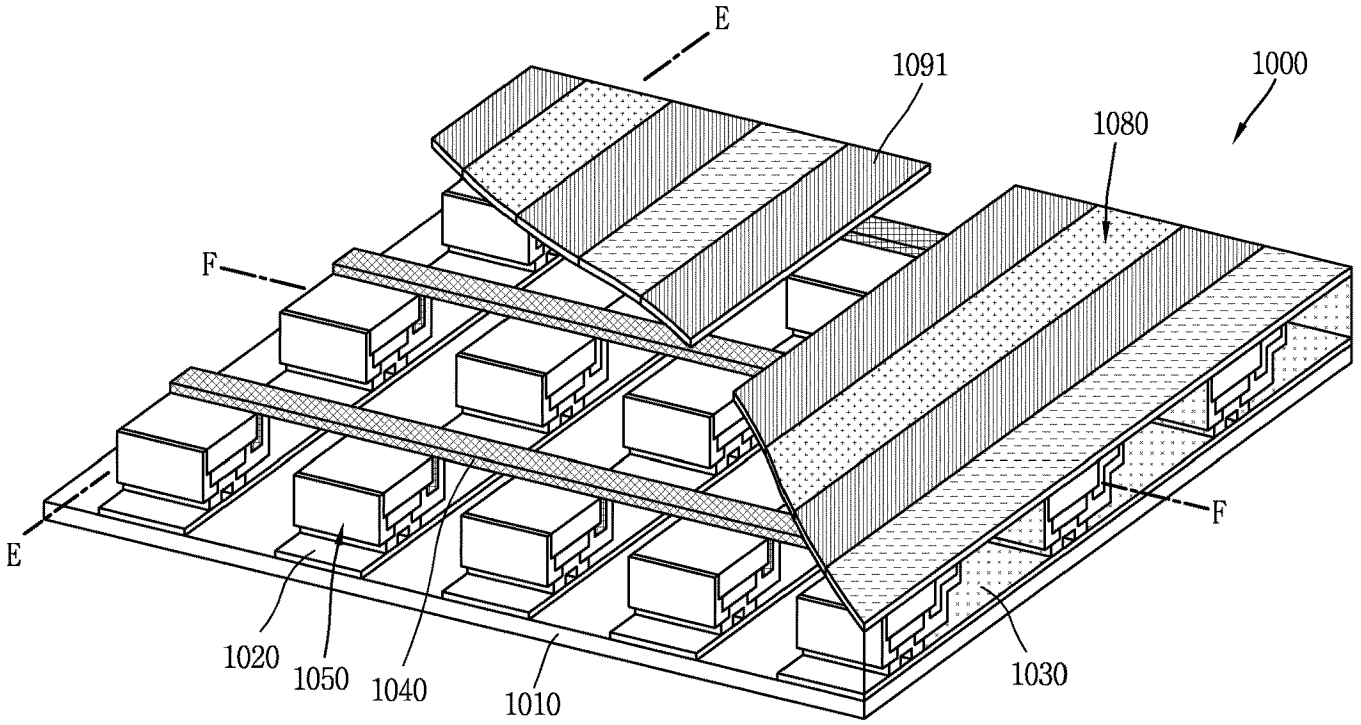
FIG. 10 is an enlarged view of portion A of FIG. 1 illustrating a semiconductor light-emitting diode with a new structure according to another exemplary embodiment of the present invention.

In particular, FIG. 10 is an enlarged view of portion A of FIG. 1 illustrating a semiconductor light-emitting diode with a new structure according to another exemplary embodiment of the present invention. In addition, FIG. 11A is a cross-sectional view taken along the line E-E of FIG. 10, FIG. 11B is a cross-sectional view taken along the line F-F of FIG. 11, and FIG. 12 is a conceptual diagram showing the flip-chip type semiconductor light-emitting diode of FIG. 11A.

Figure 11A:
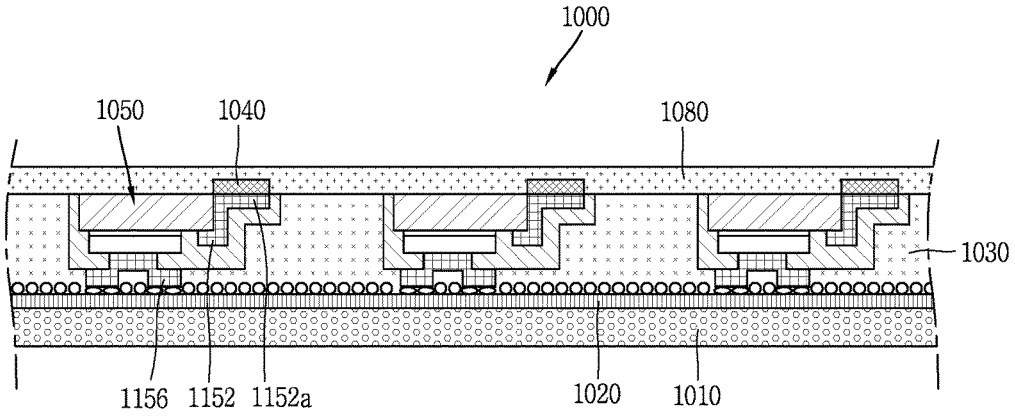
FIG. 11A is a cross-sectional view taken along the line E-E of FIG. 10.
Figure 11B:
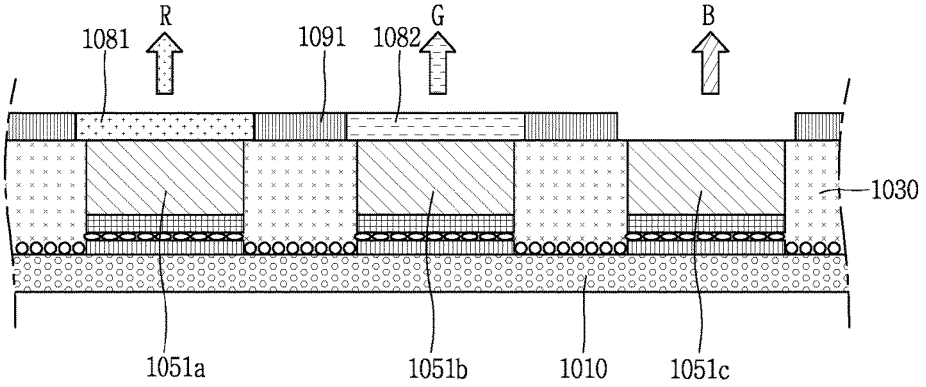
FIG. 11B is a cross-sectional view taken along the line F-F of FIG. 11.
Figure 12:
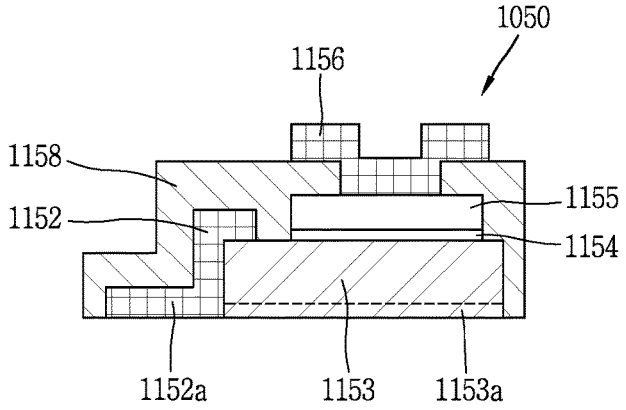
FIG. 12 is a conceptual diagram showing the flip-chip type semiconductor light-emitting diode of FIG. 11A.

As depicted in FIGS. 10, 11A, and 11B, a display device 1000 using a passive matrix (PM) semiconductor light-emitting diode is exemplified as a display device 1000 using a semiconductor light-emitting diode. The example set forth below is also applicable to an active matrix (AM) semiconductor light-emitting diode.

The display device 1000 includes a substrate 1010, one or more first electrodes 1020, a conductive adhesion layer

1030, one or more second electrodes 1040, and a plurality of semiconductor light-emitting diodes 1050. The first electrodes 1020 and the second electrodes 1040, respectively, may include a plurality of electrode lines.

The substrate 1010, a wiring substrate on which the first electrodes 1020 are located, may include polyimide PI to implement a flexible display device. Besides, any materials that have insulating properties and flexibility may be used. The first electrodes 1020 are positioned on the substrate 1010, and may be formed in the shape of a long bar along one direction. The first electrodes 1020 may act as data electrodes.

The conductive adhesion layer 1030 is formed on the substrate 1010 where the first electrodes 1020 are positioned. As with the above-described display device using a flip-chip type light-emitting device, the conductive adhesion layer 1030 may be an anisotropy conductive film (ACF), anisotropy conductive paste, a solution containing conductive particles, etc. It is to be noted that, in this exemplary embodiment, the conductive adhesion layer 1030 may be replaced by an adhesion layer. For example, if the first electrodes 1020 are not positioned on the substrate 1010 but are formed integrally with conductive electrodes of the semiconductor light-emitting diodes, the adhesion layer may not need conductivity.

The second electrodes 1040 are positioned between the semiconductor light-emitting diodes, located in a direction crossing the length of the first electrodes, and electrically connected to the semiconductor light-emitting diodes 1050. As shown, the second electrodes 1040 may be positioned over the conductive adhesion layer 1030. That is, the conductive adhesion layer 1030 is located between the wiring substrate and the second electrodes 1040. The second electrodes 1040 may be electrically connected to the semiconductor light-emitting diodes 1050 by contact with them.

With the above-described structure, the semiconductor light-emitting diodes 1050 are attached to the conductive adhesion layer 1030, and electrically connected to the first electrodes 1020 and the second electrodes 1040. In some cases, a transparent insulating layer containing silicon oxide (SiOx) may be formed on the substrate 1010 where the semiconductor light-emitting diodes 1050 are formed. If the second electrodes 1040 are put into position after the formation of the transparent insulating layer, the second electrodes 1040 are positioned on the transparent insulation layer. Also, the second electrodes 1040 may be spaced apart from the conductive adhesion layer 1030 or the transparent insulation layer.

As shown, the semiconductor light-emitting diodes 1050 may form a plurality of lines in a direction parallel to a plurality of electrode lines provided at the first electrodes 1020. However, the present invention is not limited thereto. For example, the semiconductor light-emitting diodes 1050 may form a plurality of lines along the second electrodes 1040.

In addition, the display device 1000 may further include a fluorescent layer 1080 formed on one side of the semiconductor light-emitting diodes 1050. For example, the semiconductor light-emitting diodes 1050 are blue semiconductor light-emitting diodes that emit blue (B) light, and the fluorescent layer 1080 performs the function of converting the blue (B) light into colors of unit pixels. The fluorescent layer 1080 may be a red fluorescent material 1081 or green fluorescent material 1082 that constitutes an individual pixel.

That is, a red fluorescent material 1081 capable of converting blue light into red (R) light may be stacked on a blue semiconductor light-emitting diode 1051*a* corresponding to the position of a red unit pixel, and a green fluorescent material 1082 capable of converting blue light into green (G) light may be stacked on a blue semiconductor light-emitting diode 1051*b* corresponding to the position of a green unit pixel. A blue semiconductor light-emitting diode 1051*c* alone may be used for the position of a blue unit pixel. In this instance, the unit pixels of red (R), green (G), and blue (B) may form a single pixel. More specifically, a fluorescent material of a single color may be stacked along each line of the first electrodes 1020.

Accordingly, one line of the first electrodes 1020 may be electrodes that control one color. That is, red (R), green (G), and blue (B) may be sequentially arranged along the second electrodes 1040, by which unit pixels may be produced. However, the present invention is not limited thereto, and a combination of the semiconductor light-emitting diode 1050 and quantum dots (QD), instead of fluorescent materials, may produce unit pixels that emit light of red (R), green (G), and blue (B).

The display device may further include a black matrix 1091 located between fluorescent materials, for improvement of the contrast of the fluorescent layer 1080. The black matrix 1091 may be formed so produces gaps between fluorescent dots and fills the gaps with a black material. In this way, the black matrix 1091 can absorb eternal light reflection and improve the contrast between dark and light.

The black matrix 1091 is positioned in the fluorescent layer's in-between spaces along the first electrodes 1020 along which the fluorescent layer 1080 is stacked. In this instance, although the fluorescent layer is not formed in positions corresponding to the blue semiconductor light-emitting diodes 1051*c*, the black matrix 1091 may be formed on either side of the spaces where the fluorescent layer is not formed (or on either side of the blue semiconductor light-emitting diodes 1051*c*.

The semiconductor light-emitting diodes 1050 of this example have a significant advantage of reducing the chip size since the electrodes are located longitudinally. It should be noted that, although the electrodes are located longitudinally, the semiconductor light-emitting diodes of this invention may be flip-chip type light-emitting devices.

Referring to FIG. 12, for example, the semiconductor light-emitting diode 1050 includes a first conductive electrode 1156, a first conductive semiconductor layer 1155 where the first conductive layer 1156 is formed, an active layer 1154 formed on the first conductive semiconductor layer 1155, a second conductive layer 1153 formed on the active layer 1154, and a second conductive electrode 1152 formed on the second conductive semiconductor layer 1153.

More specifically, the first conductive electrode 1156 and the first conductive semiconductor layer 1155 may be a p-type electrode and a p-type semiconductor layer, respectively, and the second conductive electrode 1152 and the second conductive semiconductor layer 1153 may be an n-type electrode and an n-type semiconductor layer, respectively. However, the present invention is not limited thereto, and the first conductive type may be n-type and the second conductive type may be p-type.

More specifically, the first conductive electrode 1156 is formed on one side of the first conductive semiconductor layer 1155, the active layer 1154 is formed between the other side of the first conductive semiconductor layer 1155 and one side of the second conductive semiconductor layer 1153, and the second conductive electrode 1152 is foimed on one side of the second conductive semiconductor layer 1153.

In this instance, the second conductive electrode 1152 may be located on one side of the second conductive semiconductor layer 1153, and an undoped semiconductor layer 1153*a* may be formed on the other side of the second conductive layer 1153. Referring to FIG. 12 along with FIGS. 10 and 11B, one side of the second conductive layer may the side closest to the wiring substrate, and the other side of the second conductive semiconductor layer may be the side farthest from the wiring substrate.

The first conductive electrode 1156 and the second conductive electrode 1152 are spaced apart from each other along the width of the semiconductor light-emitting diode 1150 and have level differences to each other in the vertical direction (or along the thickness). Using the level differences, the second conductive electrode 1152 is formed on the second conductive semiconductor layer 1153, adjacent to the second electrode 1040 positioned in an upper part of the semiconductor light-emitting diode.

For example, at least part of the second conductive electrode 1152 protrudes in the width direction from the side of the second conductive semiconductor layer 1153 (or the side of the undoped semiconductor layer 1153*a*). Since the second conductive layer 1142 protrudes from the side, the second conductive electrode 1152 may be exposed to the upper part of the semiconductor light-emitting diode. Hence, the second conductive electrode 1152 is located to overlap the second electrode 1040 located over the conductive adhesion layer 1030.

More specifically, the semiconductor light-emitting diode includes a protruding portion 1152*a* that extends from the second conductive electrode 1152 and protrudes from the side of the semiconductor light-emitting diode. In this instance, the first conductive electrode 1156 and the second conductive electrode 1152 may be expressed as being spaced apart from each other in the protruding direction of the protruding portion 1152*a* and having level differences in a direction vertical to the protruding direction.

The protruding portion 1152*a* extends laterally from one side of the second conductive semiconductor layer 1153, toward the top of the second conductive semiconductor layer 1153, more specifically, the undoped semiconductor layer 1153*a*. The protruding portion 1152*a* protrudes in the width direction (or thickness direction) from the side of the undoped semiconductor layer 1153*a*. Accordingly, the protruding portion 1152*a* may be electrically connected to the second electrode 1040 on the opposite side of the first conductive electrode 1156 with respect to the second conductive semiconductor layer 1153.

The structure with the protruding portion 1152*a* may make use of the advantages of the above-described horizontal semiconductor light-emitting diode and vertical semiconductor light-emitting diode. Fine grooves may be formed by roughing on the top of the undoped semiconductor layer 1153*a*, which is the farthest side from the first conductive electrode 1156.

The semiconductor light-emitting diode 1050 may include an insulating portion 1158 that is formed to cover the second conductive electrode 1152. The insulating portion 1158 may be formed to cover part of the first conductive semiconductor layer 1155, along with the second conductive electrode 1152.

In this instance, the second conductive electrode 1152 and the active layer 1154 are formed on one side of the second conductive semiconductor layer 1153, and spaced apart from each other in one direction, with the insulating portion 1158 between them. Here, the one direction (or horizontal direction) may be the width direction of the semiconductor light-emitting diode, and the vertical direction may be the thickness direction of the semiconductor light-emitting diode.

The first conductive electrode 1156 may be formed at an exposed portion of the first conductive semiconductor layer 1155 that is not covered by the insulating portion 1158. Accordingly, the first conductive electrode 1156 is exposed externally through the insulating portion 1158. Thus, the n-type electrode and p-type electrode of the semiconductor light-emitting diode may be insulated because the first conductive electrode 1156 and the second conductive electrode 1152 are insulated by the insulating portion 1058.

The display device 1000 may further include a fluorescent layer 1080 (see FIG. 11B) formed on one side of the semiconductor light-emitting diodes 1050. In this instance, light emitted from the semiconductor light-emitting diodes is excited using fluorescent materials, thereby producing red (R) and green (G). Also, the above-described black matrix 191, 291, and 1091 (see FIGS. 3B, 8, and 11B) acts as barrier ribs that prevent color mixing between the fluorescent materials.

The above-explained display device is suitable for implementing a circular display because the semiconductor light-emitting diodes can be arranged freely. However, it is difficult to reduce the bezel size. Concretely, in the above-described display device, wiring lines intersecting each other are located to transmit a driving signal to the semiconductor light-emitting diodes. Some of the wiring lines extending in one direction constitute scan lines for transmitting scan lines, and some of the wiring lines extending in another direction perpendicular to the one direction constitute data lines. The scan lines and the data lines are electrically connected to a driver via the wiring substrate, making it difficult to implement a circular display with a narrow bezel. In view of this, the present invention suggests a wiring structure suitable for circular displays with a narrow bezel.

Figure 13:
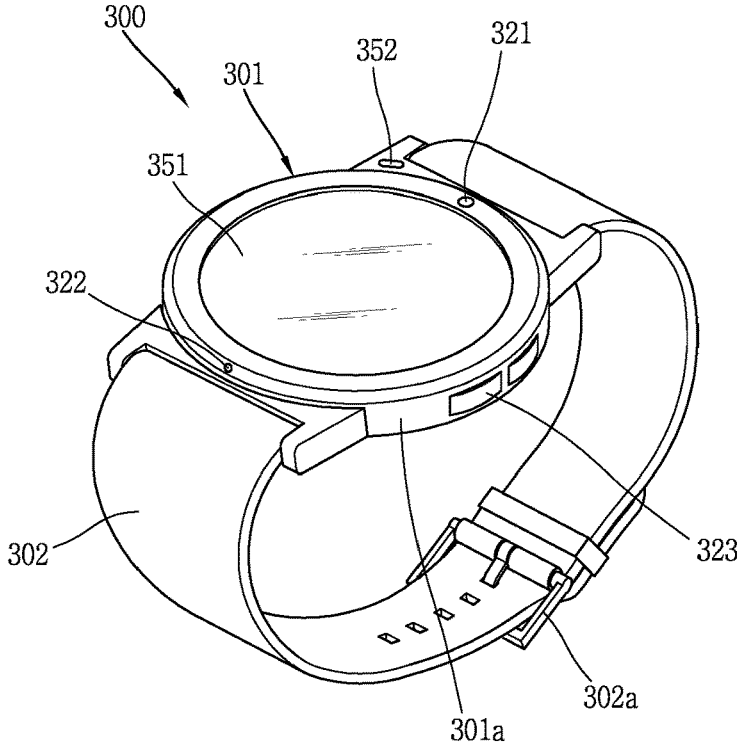
FIG. 13 is a conceptual diagram illustrating explaining a mobile terminal with a circular display using the structure of a wiring substrate according to an embodiment of the present invention.
Figure 14:
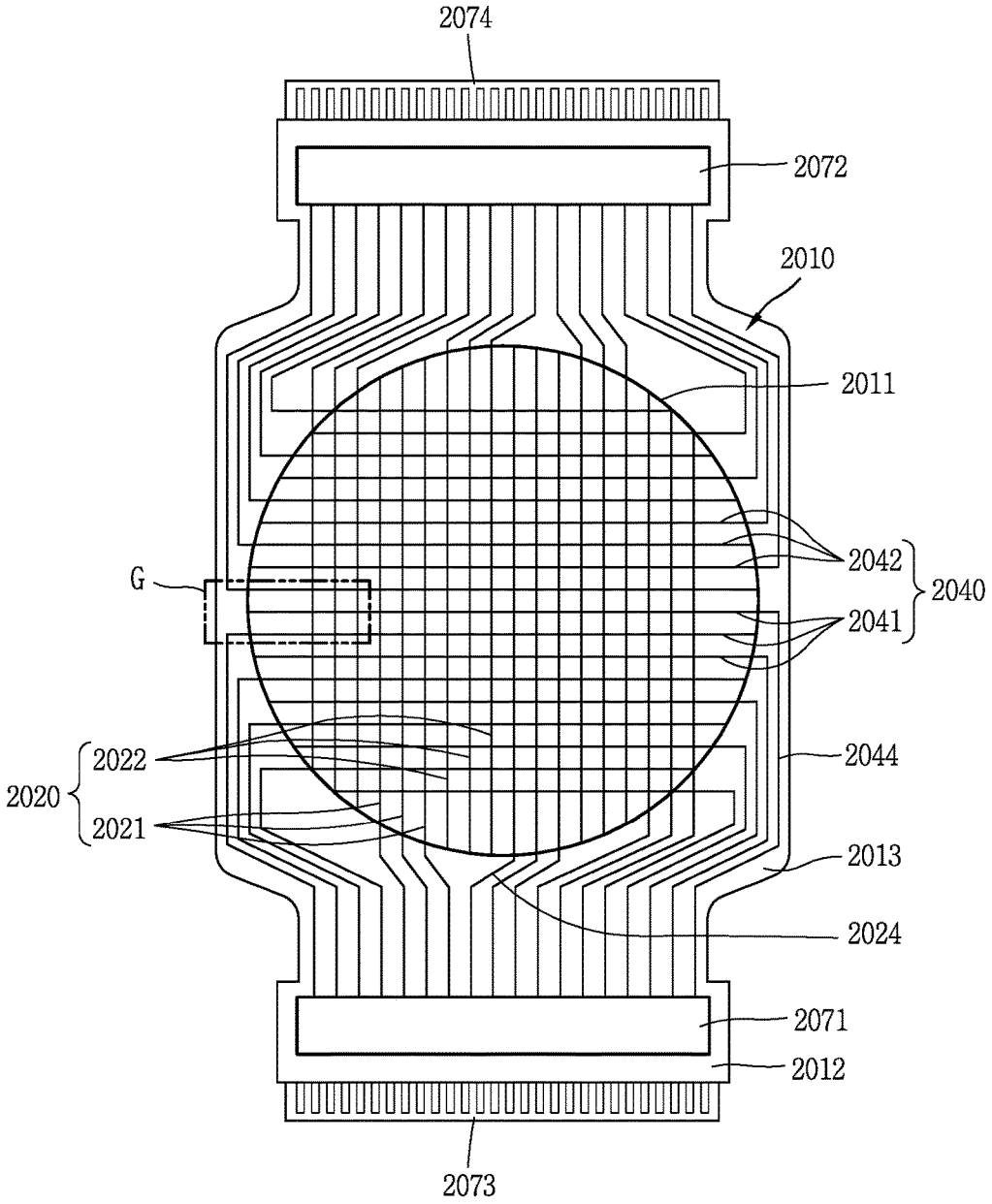
FIG. 14 is a conceptual diagram of a circular display panel using the structure of a wiring substrate according to an embodiment of the present invention.
Figure 15:
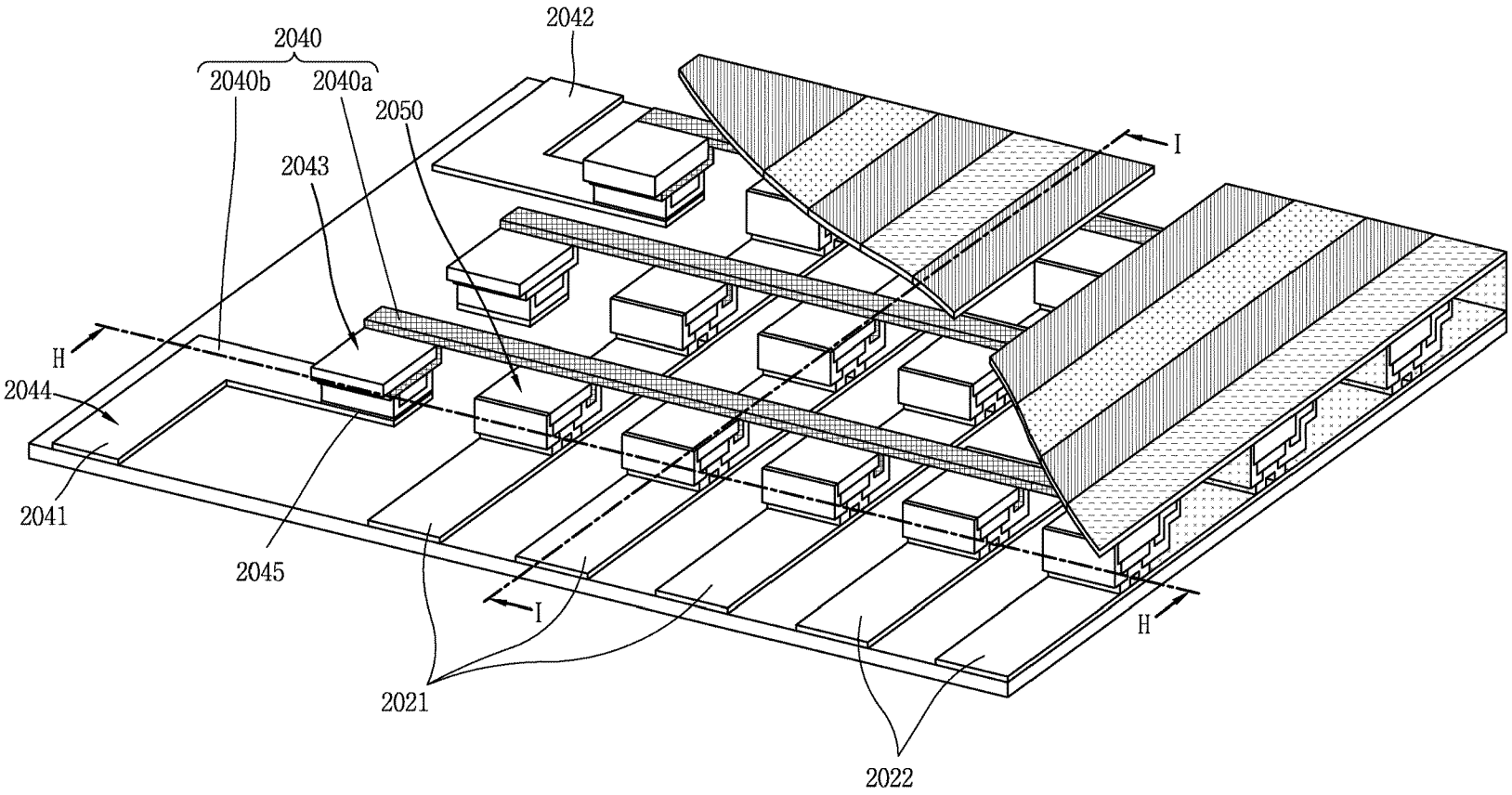
FIG. 15 is an enlarged view of portion G of FIG. 14.
Figure 16:
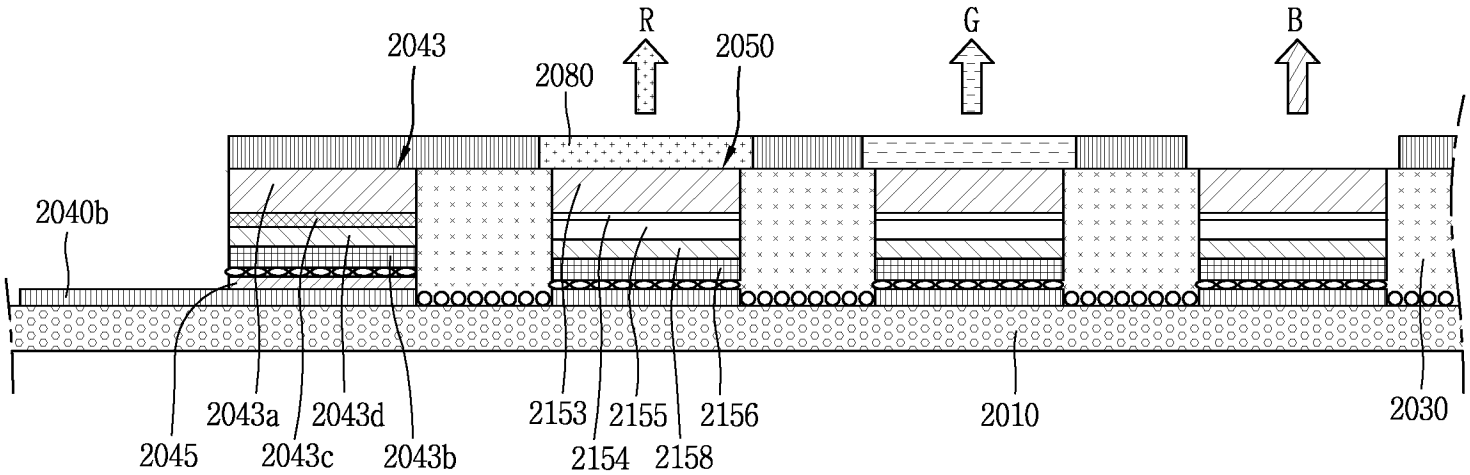
FIGS. 16 and 17 are cross-sectional views taken along the lines H-H and I-I of FIG. 15, respectively.
Figure 17:
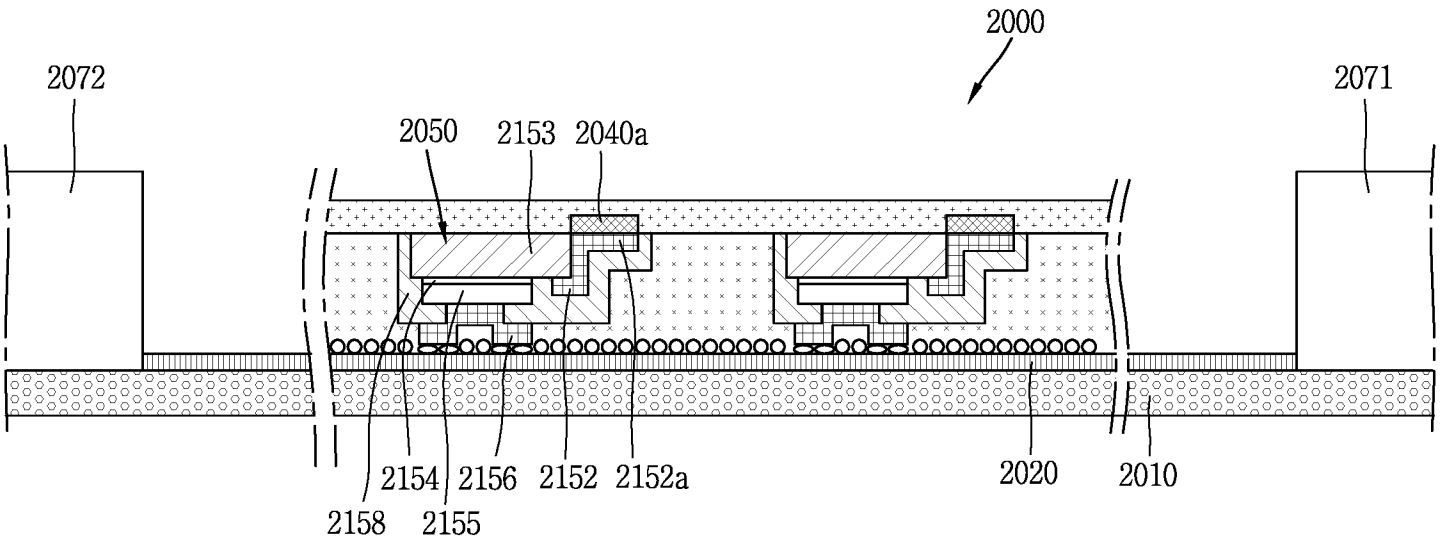

Hereinafter, the structure of the display device according to an embodiment of the present invention will be described in detail with reference to the accompanying drawings. FIG. 13 is a conceptual diagram illustrating explaining a mobile terminal with a circular display using the structure of a wiring substrate according to an embodiment of the present invention. FIG. 14 is a conceptual diagram of a circular display panel using the structure of a wiring substrate according to an embodiment of the present invention. FIG. 15 is an enlarged view of portion G of FIG. 14. FIGS. 16 and 17 are cross-sectional views taken along the lines H-H and I-I of FIG. 13, respectively.

Referring to FIG. 13, a watch-type mobile terminal 300 includes a main body 301 with a display part 351, and a band 302 that is connected to the main body 301 and can be worn on the wrist. The main body 301 includes a casing that forms the outer appearance. As depicted in the drawing, the casing may include a first casing 301*a* and second casing 301*b* that provide an internal space for housing various kinds of electronic parts. However, the present invention is not limited thereto, and a single casing may be configured to provide the internal space, thereby implementing a mobile terminal 300 with a unit body.

The watch-type mobile terminal 300 is configured to enable wireless communication, and an antenna for wireless communication may be installed in the main body 301. The antenna's performance can be extended using the casing. For example, a casing containing a conductive material may be electrically connected to the antenna to extend a ground area or a radiating area.

The display part 351 may be located on the front side of the main body 301 to output information, and the display part 351 may be implemented as a touchscreen by including a touch sensor. As depicted in the drawing, the display part 351 may be mounted on the first casing 301*a* and form the front side of the terminal body along with the first casing 301*a*.

The main body 301 may include an audio output part 352, a camera 321, a microphone 322, a user input part 323, etc. If the display part 351 is implemented as a touchscreen, it may function as the user input part 323, and therefore the main body 301 may include no keys. The band 302 is configured to be worn on the wrist and cover the wrist, and may be made of a flexible material to make it easy to wear. Examples of the flexible material may include leather, rubber, silicon, synthetic resin, etc. Also, the band 302 may be attachable and detachable to and from the main body 301 so that the user can replace it with various types of bands according to their taste.

The band 302 may be used to extend the antenna's performance. For example, the band 302 may incorporate a ground extension that is electrically connected to the antenna and extend the ground area. The band 3032 may include a fastener 302*a*. The fastener 302*a* may be implemented using a buckle, a hook with a snap-fit, or Velcro (product name), and may include a flexible portion or material. In this drawing, the fastener 302*a* is implemented as a buckle, for example.

Meanwhile, the above-described display part 351 is implemented using a semiconductor light-emitting diode, and, more specifically, it may be implemented as a circular display. For example, the display part 351 may be the display device using a flip-chip type semiconductor light-emitting diode explained with reference to FIGS. 10 to 12, and the structure of the display device 2000 will be described with reference to FIGS. 14 to 16. It is to be noted that the example set forth below is also applicable to the above-described different type of semiconductor light-emitting diode.

In the example set forth below, the same or similar components to those of the previous example explained with reference to FIGS. 10 to 12 are given the same or similar reference numerals, and a description thereof will be replaced with the foregoing description. For example, the display device 2000 includes a plurality of semiconductor light-emitting diodes 2050.

Each semiconductor light-emitting diode 2050 includes a first conductive electrode 2156, a first conductive semiconductor layer 2155 where the first conductive layer 2156 is formed, an active layer 2154 formed on the first conductive semiconductor layer 2155, a second conductive layer 2153 formed on the active layer 2154, and a second conductive electrode 2152 formed on the second conductive semiconductor layer 2153. A description thereof will be replaced with the foregoing description made with reference to FIG. 12.

As described previously with reference to FIG. 12, the protruding portion 2152*a* extends laterally from one side of the second conductive semiconductor layer 2153, toward the top of the second conductive semiconductor layer 2153, more specifically, the undoped semiconductor layer 2153*a*. Accordingly, the protruding portion 2152*a* may be electrically connected to the second electrode 2040 on the opposite side of the first conductive electrode 2156 with respect to the second conductive semiconductor layer 2153.

The semiconductor light-emitting diode 2050 may include an insulating portion 2158 that is formed to cover the second conductive electrode 2152. The insulating portion 2158 may be formed to cover part of the first conductive semiconductor layer 2155, along with the second conductive electrode 2152. The first conductive electrode 2156 may be formed at an exposed portion of the first conductive semiconductor layer 2155 that is not covered by the insulating portion 2158. Accordingly, the first conductive electrode 2156 is exposed externally through the insulating portion 2158.

Further, the display device 2000 may further include a fluorescent layer 2080 formed on one side of the semiconductor light-emitting diodes 2050. As shown, the display device 2000 includes a substrate (wiring substrate) 2010, first electrodes 2020, a conductive adhesion layer 2030, and second electrodes 2040. A basic explanation thereof will be replaced with the explanation previously made with reference to FIGS. 10 to 12.

In this exemplary embodiment, too, the conductive adhesion layer 2030 may be replaced by an adhesion layer, a plurality of semiconductor light-emitting diodes may be attached to an adhesion layer located on the wiring substrate 2010, and the first electrodes 2020 may not be positioned on the wiring substrate 2010 but may be formed integrally with conductive electrodes of the semiconductor light-emitting diodes.

The first electrodes 2020 include a plurality of data lines that transmit a data driving signal to the semiconductor light-emitting diodes. The second electrodes 2040 include a plurality of scan lines, as upper wires of the semiconductor light-emitting diodes, that transmit a scan driving signal to the semiconductor light-emitting diodes. The scan lines may be positioned on the conductive adhesion layer 2030. That is, the conductive adhesion layer 2030 is located between the wiring substrate 2010 and the second electrodes 2040. The second electrodes 2040 may be electrically connected to the protruding portions 2152*a* of the semiconductor light-emitting diodes 2050 by contact with them.

In this instance, a driver of the display device outputs a signal to the scan lines line by line, and each scan line sequentially supplies a data signal to the data lines, thereby controlling light emission of the semiconductor light-emitting diodes. In the present invention, a plurality of drivers are provided, and the scan lines and the data lines are split into two halves and connected to the drivers.

Referring to FIG. 14, a first driver 2071 and a second driver 2072 that are connected to the scan lines and the data lines and provide the scan driving signal and the data driving signal are mounted on one side of the wiring substrate 2010. More specifically, the wiring substrate 2010 may be split up into a first area 2011 where the semiconductor light-emitting diodes are mounted, and a second area 2012 where the drivers 2071 and 2072 are located.

The first area 2011 may correspond to the display part 351 and have a circular shape so that the semiconductor light-emitting diodes form a circular display. In the first area 2011, the data lines are located parallel to each other, and the data lines intersect the scan lines.

As shown, at least one of the scan lines is connected to either the first driver 2071 or the second driver 2072, and some of the data lines intersecting the at least one scan line are connected to the first driver 2071 and the others are connected to the second driver 2072. That is, the data lines intersecting one scan line are split into two halves and connected to the first driver 2071 and the second driver 2072 separately so that both of the drivers output a data signal to illuminate the scan lines any one of the drivers is in charge of. From the other perspective, the scan lines intersecting one data line are split into two halves and connected to the first driver 2071 and the second driver 2072.

In this instance, the scan lines 2040 are split up into a first scan group 2041 connected to the first driver 2071 and a second scan group 2042 connected to the second driver 2072, and the first scan group 2041 is located adjacent to the first driver 2071 and the second scan group 2042 is located adjacent to the second driver 2072. For example, the first scan group 2041 and the second scan group 2042 may be located in two halves in the first area 2011. That is, any scan line of the first scan group 2041 may extend to one side, and the next scan line may extend to the other side. Likewise, the scan lines of the second scan group 2042 may be located in the same way.

In contrast, the data lines 2020 may be located so a first data group 2021 connected to the first driver 2071 and a second data group 2022 connected to the second driver 2072 are sequentially arranged along the scan lines in repeating fashion. That is, a plurality of first data groups 2021 and a plurality of second data groups 2022 may be alternately arranged.

The first data group 2021 and the second data group 2022 extend longitudinally and are connected to the first driver 2071 and the second driver 2072, respectively. In this instance, the first data group 2021 and the second data group 2022 can supply red, green, and blue control signals to unit pixel parts that respectively emit red, green, and blue light. More specifically, the unit pixel parts may include three or more semiconductor light-emitting diodes that are respectively connected to three or more data lines. As in this example, if a semiconductor light-emitting diode is a blue semiconductor light-emitting diode that emits blue light, a red fluorescent layer and a green fluorescent layer are provided to emit red, green, and blue light individually.

Thus, the present invention provides a structure in which red, green, and blue are put together to form a pixel and wires are connected in even/odd lines and longitudinally within the pixel. However, the present invention is not limited thereto and, for example, the data lines may be located so first data lines connected to the first driver and second data lines connected to the second driver are sequentially arranged along the scan lines in a repeating fashion. In this instance, the scan lines may be arranged line by line and sequentially connected to the first driver and the second driver.

Thus, with the structure in which data lines and scan lines are split into two halves to be connected to the drivers, the panel does not need to be controlled separately in upper and lower sections or in left and right sections, as in multi-vision devices. For a multi-vision device, the panel is controlled in different sections, and the drivers are in charge of the sections, respectively. Therefore, each driver is in charge of only half of either the data lines or the scan lines and all of the other type of lines. Due to this, the bezel needs to be of a certain size.

In contrast, in the present invention, two drivers are operated such as single driver. Therefore, the two drivers are dealing with one type of lines while one of them is dealing with the other type of lines. As such, each driver is in charge of half of the data lines and half of the scan lines, thus reducing the bezel size.

With this structure, while the first driver is outputting a signal to any one of the scan lines, the first driver and the second driver can output a signal to the data lines. Also, while the second driver is outputting a signal to another one of the scan lines, the first driver and the second driver can output a signal to the data lines. Thus, the pair of drivers output a data signal to illuminate the scan lines any one of them is in charge of, and the operation of the two drivers is in timing synchronization with the operation of any one of them.

In this instance, either the first driver or the second driver can operate as a master, and the other one operate as a slave. The master driver can output a synchronization signal for timing synchronization, and the slave driver may receive the synchronization signal and operate in synchronization with the master driver. That is, the master driver controls the internal circuit in accordance with a synchronization signal generated by itself, and the slave driver controls the internal circuit in accordance with the synchronization signal generated by the master driver.

The wiring substrate 2010 may include interface parts 2073 and 2074 that are electrically connected to the drivers 2071 and 2072 and protrude from the wiring substrate 2010 to connect with an external terminal That is, the interface parts 2073 and 2074 may be located on the ends of the second area 2012, respectively.

As shown, the distance between the center of the first area 2011 and the first driver 2071 or second driver 2072 is set in consideration of the size of a growth substrate (sapphire glass) where the panel is grown. The distance between the center of the first area 2011 and the first driver 2071 or second driver 2072 may be greater than half of the length of the growth substrate where the semiconductor light-emitting diodes are grown. In a concrete example, if the growth substrate for the semiconductor light-emitting diodes is 2 inches large, the first driver 2071 and the second driver 2072 are located outside a circle with a radius of 1 inch from the center of the first area 2011. This is to prevent interference between the first and second drivers 2071 and 2072 and the growth substrate due to the height of the first and second drivers 2071 and 2072 when the semiconductor light-emitting diodes are transferred from the growth substrate to the first area 2011.

As shown, a third area 2013 is formed on the wiring substrate 2010 and is located so the scan lines and the data lines extend from the first area 2011 to the second area 2012. The third area 2013 provides a base where the data lines and scan lines connected to the semiconductor light-emitting diodes within the first area 2011 extend to be electrically connected to the driver 2071.

In this instance, the data lines are formed on one side of the wiring substrate 2010, and electrically connected to the driver 2071 from the first area 2011 through the third area 2013. In contrast, the scan lines are connected to the semiconductor light-emitting diodes, spaced apart from the wiring substrate 2010 along the thickness of the semiconductor light-emitting diodes. For example, the scan lines include first portions **2040*a* connected to the semiconductor light-emitting diodes, spaced apart from one side of the wiring substrate 2010, and second portions 2040*b* formed on one side of the wiring substrate 2010. The first portions 2040*a*** are connected to the n-type electrodes, for example, protruding portions, of the semiconductor light-emitting diodes, thereby forming upper wires. Accordingly, the data lines are connected to the p-type electrodes of the semiconductor light-emitting diodes.

The second portions **2040*b*, along with the data lines, extend toward the driver 2071 from one side of the wiring substrate 2010. In this instance, the first portions 2040*a* are spaced apart from the wiring substrate 2010 in the thickness direction of the display device, causing a level difference between the first portions 2040*a* and the second portions 2040*b***. To eliminate the level difference, connecting portions

2043 are located in the third area 2013 to interconnect the first portions 2040*a* and the second portions 2040*b*. That is, connecting portions 2043 are formed of a plurality of layers, between the scan lines and the wiring substrate 2010 so that the scan lines extend to the wiring substrate 2010.

The connecting portions 2043 may be located on either side of the first area 2011 in the third area 2013, in which case there is no limit to the distance between the connecting portions 2043 and the semiconductor light-emitting diodes. Accordingly, the distance from the boundary of the first area 2011 to the first driver or the second driver is greater than the width of portions (corresponding to the bezel) formed on either side of the first area 2011 in the third area 2013. Moreover, the connecting portions 2043 may be located along a curve in the third area 2013. The curve may be a virtual line corresponding to an arc of the first area 2011.

As shown, the connecting portions 2043 each may include a plurality of layers. For example, the connecting portions 2043 each may include a connecting semiconductor layer 2043*a* made of the same material as the n-type semiconductor layer of the semiconductor light-emitting diodes, and a conductive layer overlapping the connecting semiconductor layer 2043*a* and made of a conductive material.

The semiconductor layer 2043*a* may be made of the same material as the second conductive semiconductor layer 2153 (n-type semiconductor layer) and grown together with it on a growth substrate. Accordingly, at least part of the connecting portions 2043 may be formed so they are grown together with the semiconductor light-emitting diodes.

The conductive layer includes a first conductive layer 2043*b* and a second conductive layer 2043*c*. The first conductive layer 2043*b* may be made of the same material as the first conductive electrode 2156, and the second conductive layer 2043*c* may be formed of the same material as the second conductive electrode 2152. The connecting portions 2043 may have connecting insulation portions 2043*d* made of the same material as the insulating portions 2158 of the semiconductor light-emitting didoes.

As the conductive layer includes the first conductive layer 2043*b* and the second conductive layer 2043*c*, the connecting portions 2043 are almost the same height as the semiconductor light-emitting diodes. However, the present invention is not necessarily limited thereto, and the conductive layer, for example, may include either the first conductive layer 2043*b* or the second conductive layer 2043*c*.

The connecting portions 2043 may be electrically connected to scan connecting wires 2044 of the wiring substrate through a conductive adhesion layer 2030 for bonding the semiconductor light-emitting diodes to the wiring substrate. In this instance, the scan connecting wires 2044 may be formed as part of the scan lines on the wiring substrate 2010 and connected to the first driver 2071 or the second driver 2072. In this instance, wires extending from the data lines and running from the third area to the second area may be referred to as data connecting wires 2024.

Also, conductive pads 2045 electrically connected to the connecting portions 2043 by the conductive adhesion layer 2030 may be located on the wiring substrate 2010, and the conductive pads 2045 may be electrically connected to the scan connecting wires 2044. With the above-explained structure, the data lines and the scan lines are split into two halves to be connected to the drivers, thereby implementing a circular display with a narrow bezel size on the left and right. Also, a driving substrate where drivers are formed is not needed because the drivers are mounted on the wiring substrate.

In addition, a passivation layer with a solder resist coated on it is formed in the second area 2012 and no solder resist may be coated in the first area 2011 and the third area 2013. This is to alleviate or prevent bonding defects caused by a level difference between the first area and the solder resist coating layer when transferring the semiconductor light-emitting diodes from the growth substrate to the first area.

The wiring substrate of this invention may employ a double-sided wiring substrate in which electrodes are provided on both sides of the wiring substrate, as well as a single-sided wiring substrate structure in which data lines and scan connecting wires are provided on one side. In this instance, the bezel size can be further reduced. Hereinafter, this structure will be explained with reference to FIGS. 18 to 20.

Figure 18:
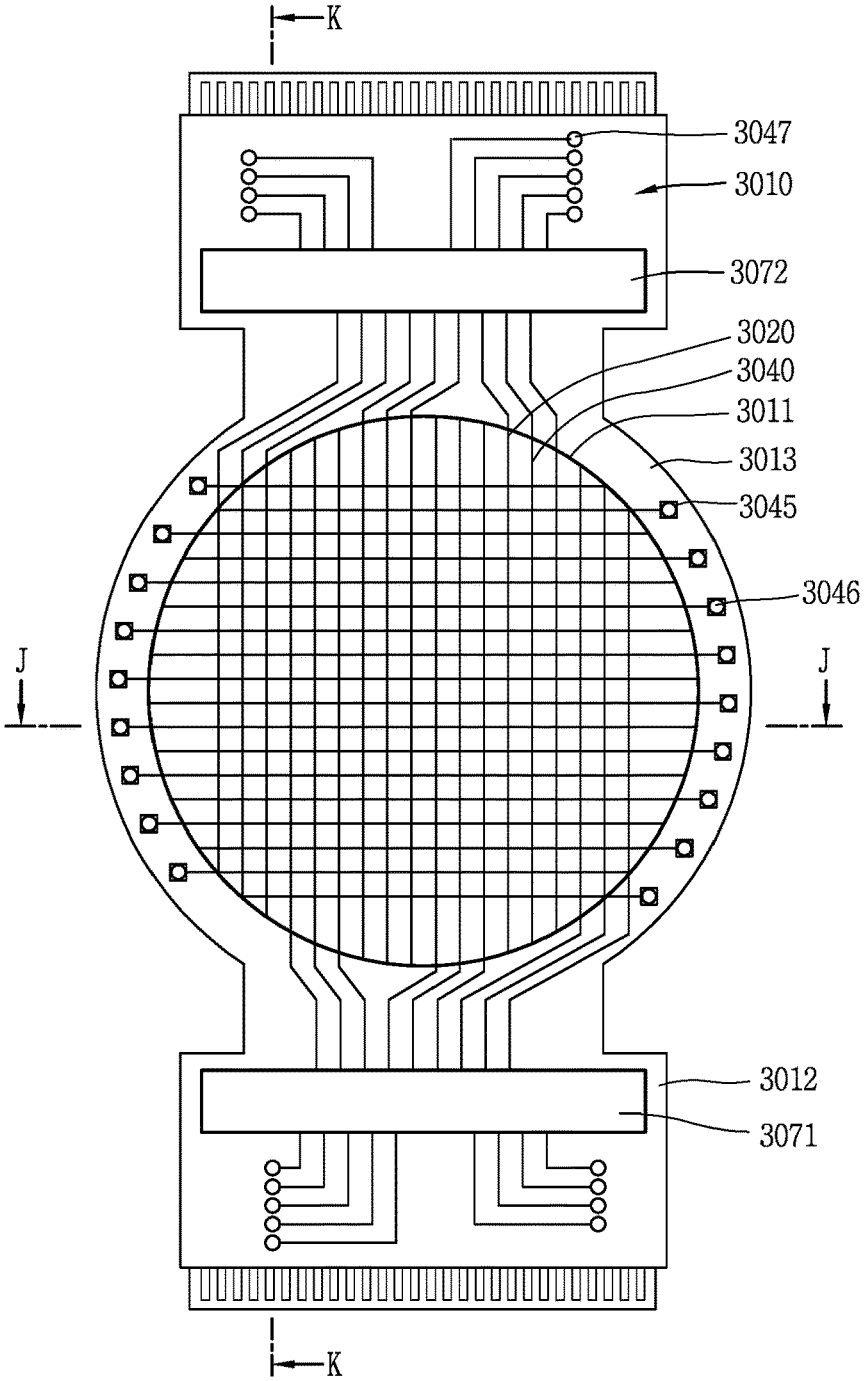
FIGS. 18 and 19 are a top plan view and rear view of a display panel according to yet another exemplary embodiment of the present invention.
Figure 19:
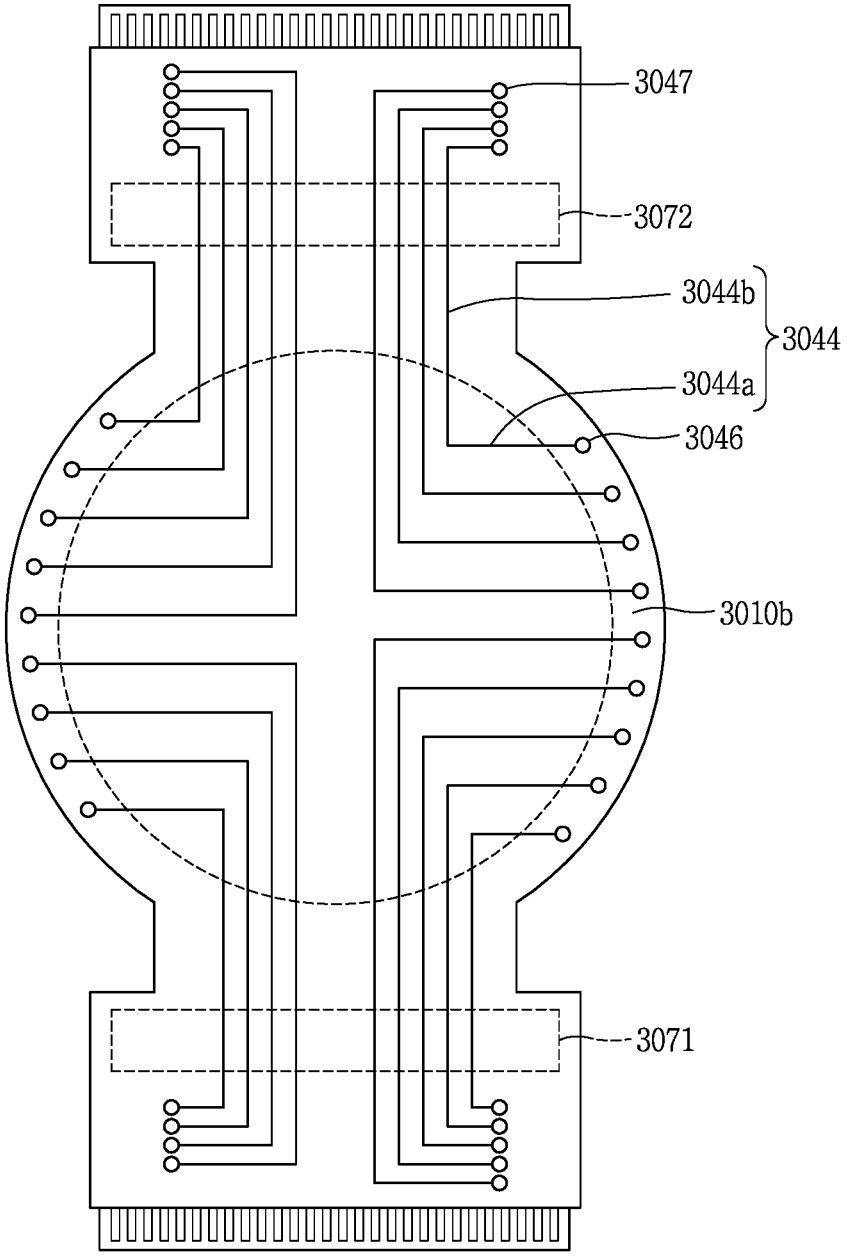
Figure 20:
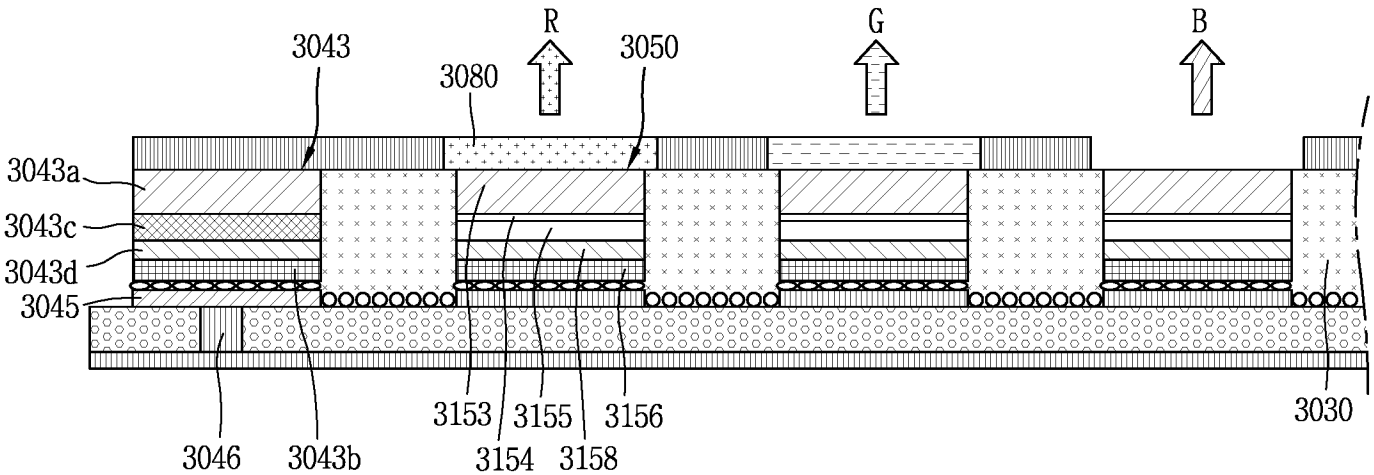
FIGS. 20 and 21 are cross-sectional views of a display device taken along the line J-J and line K-K of FIG. 18.
Figure 21:
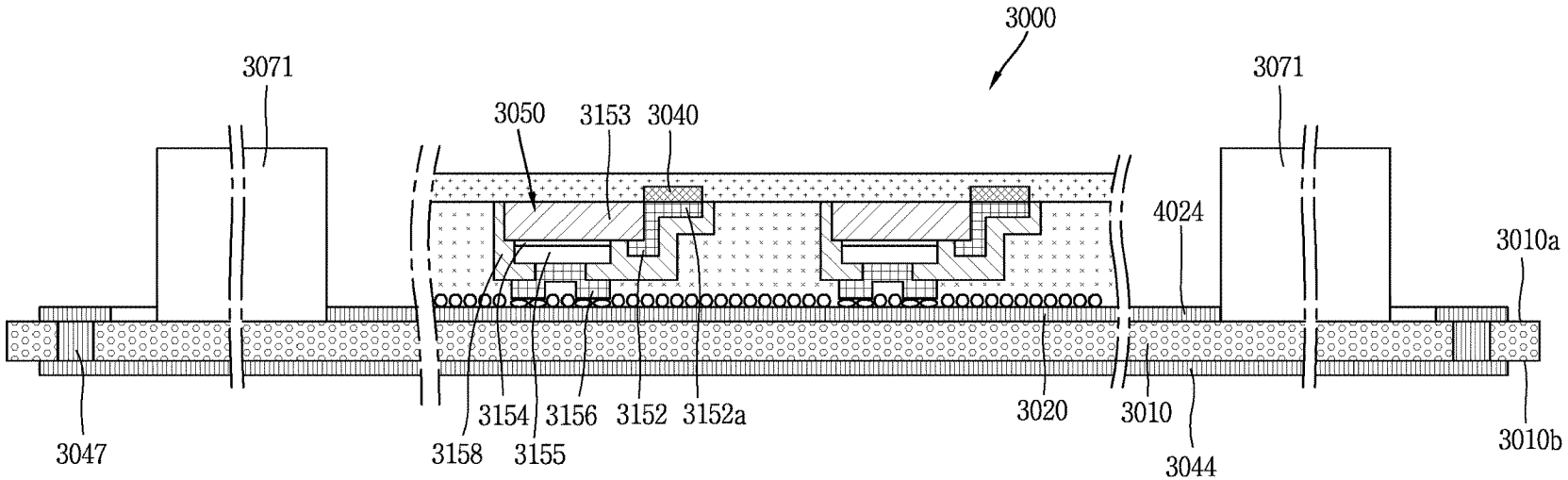

FIGS. 18 and 19 are a top plan view and rear view of a display panel according to yet another exemplary embodiment of the present invention. FIGS. 20 and 21 are cross-sectional views of a display device taken along the line J-J and line K-K of FIG. 18. In the example set forth below, the same or similar components to those of the previous example explained with reference to FIGS. 13 to 17 are given the same or similar reference numerals, and a description thereof will be replaced with the foregoing description.

For example, the display device 3000 includes a plurality of semiconductor light-emitting diodes 3050. Each semiconductor light-emitting diode 3050 includes a first conductive electrode 3156, a first conductive semiconductor layer 3155 where the first conductive layer 3156 is formed, an active layer 3154 formed on the first conductive semiconductor layer 3155, a second conductive layer 3153 formed on the active layer 3154, and a second conductive electrode 3152 formed on the second conductive semiconductor layer 3153. A description thereof will be replaced with the foregoing description made with reference to FIG. 12.

As described previously with reference to FIG. 12, the protruding portion 3152*a* extends laterally from one side of the second conductive semiconductor layer 3153, toward the top of the second conductive semiconductor layer 3153, more specifically, the undoped semiconductor layer 3153*a*. Accordingly, the protruding portion 3152*a* may be electrically connected to the second electrode 3040 on the opposite side of the first conductive electrode 3156 with respect to the second conductive semiconductor layer 3153.

Further, the display device 3000 may further include a fluorescent layer 3080 formed on one side of the semiconductor light-emitting diodes 3050. As shown, the display device 3000 includes a substrate (wiring substrate) 3010, first electrodes 3020, a conductive adhesion layer 3030, and second electrodes 3040. A basic explanation thereof will be replaced with the explanation previously made with reference to FIGS. 10 to 12.

In this embodiment, too, the conductive adhesion layer 3030 may be replaced by an adhesion layer, a plurality of semiconductor light-emitting diodes may be attached to an adhesion layer located on the wiring substrate 3010, and the first electrodes 3020 may not be positioned on the wiring substrate 3010 but may be formed integrally with conductive electrodes of the semiconductor light-emitting diodes.

The first electrodes 3020 include a plurality of data lines that transmit a data driving signal to the semiconductor light-emitting diodes. The second electrodes 3040 include a plurality of scan lines, as upper wires of the semiconductor light-emitting diodes, that transmit a scan driving signal to the semiconductor light-emitting diodes The scan lines may be positioned on the conductive adhesion layer 3030. That is, the conductive adhesion layer 3030 is located between the wiring substrate 3010 and the second electrodes 3040. The second electrodes 3040 may be electrically connected to the protruding portions 3152*a* of the semiconductor light-emitting diodes 3050 by contact with them.

A first driver 3071 and a second driver 3072 connected to the scan lines and the data lines to provide the scan driving signal and the data driving signal are mounted on one side of the wiring substrate 3010. As in the example explained with reference to FIGS. 13 to 17, the first electrodes 3020 and the second electrodes 3040 extend from the first area 3011 of the wiring substrate 3010 and are connected to the drivers located in the second area 3012 through the third area 3013.

In this example, however, connecting wires 3024 and 3044 connecting the first electrodes 3020 and the second electrodes 3040 to the first driver 3071 and the second driver 3072 are formed on both sides of the wiring substrate 3010. In this example, the bezel size of the display device can be reduced by forming the wires on both sides of the wiring substrate 3010.

The connecting wires 3024 and 3044 include data connecting wires 3024 and scan connecting wires 3044. The data connecting wires 3024 are faulted on one side 3010*a* of the wiring substrate 3010 and electrically connected to the second electrodes 3040, i.e., the data lines in the first area 3011. In contrast, the scan connecting wires 3044 extend from the first electrodes 3020, i.e., the scan lines in the first area 3011, and are located on the other side 3010*b* of the wiring substrate 3010, which is opposite to the one side 3010*a* of the wiring substrate 3010.

For example, the data lines may be formed on one side of the wiring substrate 3010 and extend to the first driver 3071 and the second driver 3072, and the scan lines may be electrically connected through the connecting portions 3043 to the scan connecting wires 3044 formed on the other side of the wiring substrate 3010. The connecting portions 3043 employ the structure of the connecting portions explained with respect to FIGS. 13 to 17, and a description thereof will be replaced with the foregoing description.

As shown, at least part of the data connecting wires 3024 and at least part of the scan connecting wires 3044 overlap in the thickness direction of the wiring substrate 3010. The data connecting wires 3024 and the scan connecting wires 3044 are located in different planes, thus allowing the wires to overlap each other.

As shown, via holes 3046 and 3047 are formed in the wiring substrate 3010 so that the scan lines in the first area are electrically connected to the scan connecting wires 3044 overlapping the data connecting wires 3024 in the third area 3013. For example, first via holes 3046, which electrically connect the connecting portions 3043 and the scan connecting wires 3044, and second via holes 3047, which connect the scan connecting wires 3044 to one side of the wiring substrate 3010 so that the scan connecting wires 3044 are connected to the first driver 3071 or the second driver 3072, may be formed on the wiring substrate 3010. The above-mentioned conductive pads 3045 may be located between the first via holes 3046 and the connecting portions 3043.

As shown, the first via holes 3046 include a first group 3046*a* and a second group 3046*b* that are located adjacent to each other on either side of the first area 3011, and the scan connecting wires 3044 extend in a symmetrical fashion, from the first and second groups 3046*a* and 3046*b* toward the second area 3012.

A single connecting wire, for example, a scan connecting wire 3044, includes a horizontal portion 3044*a* and a vertical portion 3044*b*. The horizontal portion 3044*a* may be a portion that extends from a first via hole 3046 toward the inside of the wiring substrate 3010, and the vertical portion 3044*b* may be a portion that extends from the horizontal portion 3044*a* in a vertical direction—the same direction as the data connecting wires 3024 extend.

As shown, the data connecting wires 3024 and the scan connecting wires 3044 extend as far as the second area 3012 of the wiring substrate 3010, and are connected to the drivers in the second area 3012. The second via holes 3047, through which the scan connecting wires 3044 extend to one side of the wiring substrate 3010, are formed on the wiring substrate 3010, and the scan connecting wires 3044 may be connected to the drivers in the same plane as the data connecting wires 3024.

More specifically, because the data connecting wires 3024 are located on the same plane as the drivers and the scan connecting wires 3044 are located in a different plane, the scan connecting wires 3044 extend through the second via holes 3047 to one side of the wiring substrate 3010 where the drivers are located. The second via holes 3047 are formed farther away from the first area 3011 than the first driver 3071 or the second driver 3072. Subsequently, the scan connecting wires 3044 and the data connecting wires 3024 may be connected to the drivers on either side of the drivers. With this structure, the width of the portions for the connecting wires on the wiring substrate may be reduced, thus making the bezel slim.

According to an embodiment of the present invention, the data lines and the scan lines are split into two halves to be connected to the drivers, thereby implementing a circular display with a narrow bezel size on the left and right. Accordingly, a mobile product with a circular display, such as a circular smartwatch, can be implemented.

Moreover, display control is possible even when the data lines and the scan lines are split into two halves, because both of the drivers output a data signal to illuminate the scan lines any one of the drivers is in charge of. Also, a driving substrate where drivers are formed is not needed because the drivers are mounted on the wiring substrate. Subsequently, a process of bonding the driving substrate and the wiring substrate can be omitted, and therefore bonding defects can be avoided. Further, openings and shorts between display lines caused by the bonding defects can be prevented.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A display device comprising:

semiconductor light-emitting diodes;

a plurality of scan lines configured to transmit a scan driving signal to the semiconductor light-emitting diodes and located parallel to each other, wherein the scan lines are connected to the semiconductor light-emitting diodes and spaced apart from a wiring substrate along a thickness of the semiconductor light-emitting diodes;

a plurality of data lines intersecting the scan lines and configured to transmit a data driving signal to the semiconductor light-emitting diodes, wherein the data lines are formed on the wiring substrate and connected to the semiconductor light-emitting diodes;

a first driver and a second driver connected to the scan lines and the data lines and configured to provide the scan driving signal and the data driving signal; and connecting portions including a plurality of layers located between the scan lines and the wiring substrate so that the scan lines extend to the wiring substrate, wherein the data lines are split into a first data group of data lines connected to the first driver and a second data group of data lines connected to the second driver, and wherein the connecting portions each comprise:

a connecting semiconductor layer made of a same material as an n-type semiconductor layer of the semiconductor light-emitting diodes;

a first conductive layer made of a same material as a first conductive electrode of the semiconductor light-emitting diodes; and a second conductive layer made of a same material as a second conductive electrode of the semiconductor light-emitting diodes.

2. The display device of claim 1, wherein the first driver and the second driver are further configured to output a signal to the data lines while the first driver is outputting a signal to any one of the scan lines.

3. The display device of claim 2, wherein the first driver and the second driver are further configured to output a signal to the data lines while the second driver is outputting a signal to another one of the scan lines.

4. The display device of claim 1, wherein the scan lines are split into a first scan group of scan lines connected to the first driver and a second scan group of scan lines connected to the second driver, and the first scan group is located adjacent to the first driver and the second scan group is located adjacent to the second driver.

5. The display device of claim 4, wherein the first and second data groups of the data lines are sequentially arranged along the scan lines in a repeating fashion.

6. The display device of claim 5, wherein the first data group and the second data group supply red, green, and blue control signals to unit pixel parts that respectively emit red, green, and blue light.

7. The display device of claim 4, wherein the first and second scan groups of the scan lines are sequentially arranged along the data lines in a repeating fashion.

8. The display device of claim 1, wherein either the first driver or the second driver is configured to operate as a master, and the other driver is configured to operate as a slave.

9. The display device of claim 8, wherein the master driver is further configured to output a synchronization signal for timing synchronization, and the slave driver is further configured to receive the synchronization signal and operate in synchronization with the master driver.

10. The display device of claim 1, further comprising:

conductive pads electrically connected to the connecting portions by a conductive adhesion layer located on the wiring substrate, wherein the conductive pads are electrically connected to scan connecting wires formed on the wiring substrate.

11. The display device of claim 1, wherein the data lines are formed on one side of the wiring substrate and extend to the first driver and the second driver, and the scan lines are electrically connected through the connecting portions to the scan connecting wires formed on the other side of the wiring substrate.

12. The display device of claim 11, further comprising:

first via holes, which electrically connect the connecting portions and the scan connecting wires, and second via holes, which connect the scan connecting wires to one side of the wiring substrate so that the scan connecting wires are connected to the first driver or the second driver, formed on the wiring substrate.

13. The display device of claim 1, wherein the first driver and the second driver are located on one side of the wiring substrate.

14. The display device of claim 13, wherein the wiring substrate comprises:

a first area where the semiconductor light-emitting diodes are mounted;

a second area where the first and second drivers are located; and a third area located so that the scan lines and the data lines extend from the first area to the second area.

15. The display device of claim 14, wherein a distance from a boundary of the first area to the first driver or the second driver is greater than a width of portions formed on either side of the first area in the third area.

16. The display device of claim 14, wherein the first area has a circular shape so that the semiconductor light-emitting diodes foam a circular display.

17. The display device of claim 14, wherein the connecting portions are located along a curve in the third area.

* * * * *